US010866022B2

(12) United States Patent
Krishnamurthy et al.

(10) Patent No.: US 10,866,022 B2
(45) Date of Patent: Dec. 15, 2020

(54) METHOD AND SYSTEM FOR COOLING A HYDROCARBON STREAM USING A GAS PHASE REFRIGERANT

(71) Applicant: Air Products and Chemicals, Inc., Allentown, PA (US)

(72) Inventors: Gowri Krishnamurthy, Sellersville, PA (US); Mark Julian Roberts, Kempton, PA (US)

(73) Assignee: Air Products and Chemicals, Inc., Allentown, PA (US)

( * ) Notice: Subject to any disclaimer, the term of this patent is extended or adjusted under 35 U.S.C. 154(b) by 122 days.

(21) Appl. No.: 15/964,302

(22) Filed: Apr. 27, 2018

(65) Prior Publication Data

US 2019/0331413 A1 Oct. 31, 2019

(51) Int. Cl.
*F25J 1/02* (2006.01)
*F25J 1/00* (2006.01)

(52) U.S. Cl.
CPC ..... *F25J 1/0022* (2013.01); *F25J 1/0047* (2013.01); *F25J 1/0072* (2013.01); *F25J 1/0082* (2013.01); *F25J 1/0214* (2013.01); *F25J 2270/66* (2013.01); *F25J 2290/32* (2013.01)

(58) Field of Classification Search
CPC ..... F25J 1/0022; F25J 1/0212; F25J 1/0047; F25J 1/0067; F25J 1/0082; F25J 2290/32; F25J 2270/66
See application file for complete search history.

(56) References Cited

U.S. PATENT DOCUMENTS

| | | | |
|---|---|---|---|
| 3,162,519 | A | 12/1964 | Peters et al. |
| 3,616,652 | A | 11/1971 | Engel |
| 4,339,253 | A | 7/1982 | Caetani et al. |
| 4,541,852 | A | 9/1985 | Newton et al. |
| 4,778,497 | A | 10/1988 | Hanson et al. |
| 5,916,260 | A | 6/1999 | Dubar |
| 6,250,244 | B1 | 6/2001 | Dubar et al. |
| 6,351,969 | B1 | 3/2002 | Arman et al. |

(Continued)

FOREIGN PATENT DOCUMENTS

| | | |
|---|---|---|
| CN | 105823304 | 8/2016 |
| DE | 1268161 | 5/1968 |
| DE | 102006039889 | 2/2008 |

OTHER PUBLICATIONS

Karlheinz Mueller, et al, "Erdgasverfluessigung durch einen Expansionsturbinen-Gemischkreislauffl", Linde Berichte Aus Tech:Und Wissenschaft, vol. 30, Jun. 1, 1976, pp. 36-41.

(Continued)

*Primary Examiner* — Brian M King
(74) *Attorney, Agent, or Firm* — Amy Carr-Trexler

(57) ABSTRACT

Described herein are methods and systems for the liquefaction of a natural gas stream using a refrigerant comprising methane or a mixture of methane and nitrogen. The methods and systems use a refrigeration circuit and cycle that employs one or more turbo-expanders to expand one or more streams of gaseous refrigerant to provide one or more streams of at least predominantly gaseous refrigerant that are used to provide refrigeration for liquefying and/or precooling the natural gas, and a J-T valve to expand down to a lower pressure a stream of liquid or two-phase refrigerant to provide a vaporizing stream of refrigerant that provides refrigeration for sub-cooling.

18 Claims, 8 Drawing Sheets

(56) References Cited

U.S. PATENT DOCUMENTS

| | | | | |
|---|---|---|---|---|
| 6,412,302 | B1 | 7/2002 | Foglietta | |
| 6,446,465 | B1 | 9/2002 | Dubar | |
| 6,658,890 | B1 | 12/2003 | Hahn et al. | |
| 7,234,321 | B2 | 6/2007 | Maunder et al. | |
| 7,581,411 | B2 | 9/2009 | Mostello | |
| 8,464,551 | B2 | 6/2013 | Roberts et al. | |
| 8,656,733 | B2 | 2/2014 | Roberts et al. | |
| 9,163,873 | B2 | 10/2015 | Jakobsen et al. | |
| 2005/0056051 | A1 | 3/2005 | Roberts et al. | |
| 2009/0282862 | A1* | 11/2009 | Chantant | F25J 1/0022 62/614 |
| 2010/0175425 | A1 | 7/2010 | Walther | |
| 2010/0223951 | A1* | 9/2010 | Jager | F25J 1/0042 62/613 |
| 2010/0281915 | A1* | 11/2010 | Roberts | C09K 5/041 62/612 |
| 2011/0113825 | A1 | 5/2011 | Neeraas et al. | |
| 2011/0203312 | A1* | 8/2011 | Jakobsen | F25J 1/0022 62/613 |
| 2011/0226008 | A1* | 9/2011 | Gushanas | F25J 1/0012 62/613 |
| 2014/0083132 | A1 | 3/2014 | Maunder et al. | |
| 2014/0245780 | A1 | 9/2014 | Wyllie et al. | |
| 2015/0135734 | A1 | 5/2015 | Carlander-Reuterfelt | |
| 2015/0204603 | A1 | 7/2015 | Sheng et al. | |
| 2016/0054053 | A1* | 2/2016 | Bauer | F25J 1/0212 62/613 |
| 2016/0313057 | A1 | 10/2016 | Roberts et al. | |
| 2016/0327335 | A1 | 11/2016 | Brostow et al. | |

OTHER PUBLICATIONS

Pierre Rabeau, et al, "How to Reduce CO2 Emissions in the LNG Chain", International Conference and Exhibition on Liquefied Natural Gas, vol. 15, Apr. 24, 2007, pp. PS2-7.

James C. Bronfenbrenner, et al, "Selecting a suitable process", Review the process technology options available for the liquefaction of natural gas, Summer 09, lngindustry.com.

* cited by examiner

METHOD AND SYSTEM FOR COOLING A HYDROCARBON STREAM USING A GAS PHASE REFRIGERANT

BACKGROUND

The present invention relates to a method and system for liquefying a natural gas feed stream to produce a liquefied natural gas (LNG) product.

The liquefaction of natural gas is an important industrial process. The worldwide production capacity for LNG is more than 300 MTPA, and a variety of refrigeration cycles for liquefying natural gas have been successfully developed, and are known and widely used in the art.

Some cycles utilize a vaporizing refrigerant to provide the cooling duty for liquefying the natural gas. In these cycles, the initially gaseous, warm refrigerant (which may, for example, be a pure, single component refrigerant, or a mixed refrigerant) is compressed, cooled and liquefied to provide a liquid refrigerant. This liquid refrigerant is then expanded so as to produce a cold vaporizing refrigerant that is used to liquefy the natural gas via indirect heat exchange between the refrigerant and natural gas. The resulting warmed vaporized refrigerant can then be compressed to start the cycle again. Exemplary cycles of this type that are known and used in the art include the single mixed refrigerant (SMR) cycle, cascade cycle, dual mixed refrigerant (DMR) cycle, and propane pre-cooled mixed refrigeration (C3MR) cycle.

Other cycles utilize a gaseous expansion cycle to provide the cooling duty for liquefying the natural gas. In these cycles, the gaseous refrigerant does not change phase during the cycle. The gaseous warm refrigerant is compressed and cooled to form a compressed refrigerant. The compressed refrigerant is then expanded to further cool the refrigerant, resulting in an expanded cold refrigerant that is then used to liquefy the natural gas via indirect heat exchange between the refrigerant and natural gas. The resulting warmed expanded refrigerant can then be compressed to start the cycle again. Exemplary cycles of this type that are known and used in the art are Reverse Brayton cycles, such as the nitrogen expander cycle and the methane expander cycle.

Further discussion of the established nitrogen expander cycle, cascade, SMR and C3MR processes and their use in liquefying natural gas can, for example, be found in "*Selecting a suitable process*", by J. C. Bronfenbrenner, M. Pillarella, and J. Solomon, *Review the process technology options available for the liquefaction of natural gas*, summer 09, LNGINDUSTRY.COM A current trend in the LNG industry is to develop remote offshore gas fields, which will require a system for liquefying natural gas to be built on a floating platform, such applications also being known in the art as Floating LNG (FLNG) applications. Designing and operating such a LNG plant on a floating platform poses, however, a number of challenges that need to be overcome. Motion on the floating platform is one of the main challenges. Conventional liquefaction processes that use mixed refrigerant (MR) involve two-phase flow and separation of the liquid and vapor phases at certain points of the refrigeration cycle, which may lead to reduced performance due to liquid-vapor maldistribution if employed on a floating platform. In addition, in any of the refrigeration cycles that employ a liquefied refrigerant, liquid sloshing may cause additional mechanical stresses. Storage of an inventory of flammable components is another concern for many LNG plants that employ refrigeration cycles because of safety considerations.

Another trend in the industry is the development smaller scale liquefaction facilities, such as in the case of peak shaving facilities, or modularized liquefaction facilities where multiple lower capacity liquefaction trains are used instead of a single high capacity train. It is desirable to develop liquefaction cycles that have high process efficiency at lower capacities.

As a result, there is an increasing need for the development of a process for liquefying natural gas that involves minimal two-phase flow, requires minimal flammable refrigerant inventory, and has high process efficiency.

The nitrogen recycle expander process is, as noted above, a well-known process that uses gaseous nitrogen as refrigerant. This process eliminates the usage of mixed refrigerant, and hence it represents an attractive alternative for FLNG facilities and for land-based LNG facilities which require minimum hydrocarbon inventory. However, the nitrogen recycle expander process has a relatively lower efficiency and involves larger heat exchangers, compressors, expanders and pipe sizes. In addition, the process depends on the availability of relatively large quantities of pure nitrogen.

U.S. Pat. Nos. 8,656,733 and 8,464,551 teach liquefaction methods and systems in which a closed-loop gaseous expander cycle, using for example gaseous nitrogen as the refrigerant, is used to liquefy and sub-cool a feed stream, such as for example a natural gas feed stream. The described refrigeration circuit and cycle employs a plurality turbo-expanders to produce a plurality of streams of expanded cold gaseous refrigerant, with the refrigerant stream that subcools the natural gas being let down to a lower pressure and temperature than the refrigerant stream that is used to liquefy the natural gas.

US 2016/054053 and U.S. Pat. No. 7,581,411 teach processes and systems for liquefying a natural gas stream, in which a refrigerant, such as nitrogen, is expanded to produce a plurality of refrigerant streams at comparable pressures. The refrigerant streams streams used for precooling and liquefying the natural gas are gaseous streams that are expanded in turbo-expanders, while the refrigerant stream used for subcooling the natural gas is at least partially liquefied before being expanded through a J-T valve. All the streams of refrigerant are let down to the same or approximately the same pressure and are mixed as they pass through and are warmed in the various heat exchanger sections, so as to form a single warm stream that is introduced into a shared compressor for recompression.

U.S. Pat. No. 9,163,873 teaches a process and system for liquefying a natural gas stream in which a plurality of turbo-expanders are used to expand a gaseous refrigerant, such a nitrogen, to produce a plurality of streams of cold expanded gaseous refrigerant, at different pressures and temperatures. As in U.S. Pat. Nos. 8,656,733 and 8,464,551, the lowest pressure and temperature stream is used for sub-cooling the natural gas.

US 2016/0313057 A1 teaches methods and systems for liquefying a natural gas feed stream having particular suitability for FLNG applications. In the described methods and systems, a gaseous methane or natural gas refrigerant is expanded in a plurality of turbo-expanders to provide cold expanded gaseous streams of refrigerant that are used for precooling and liquefying the natural gas feed stream. All the streams of refrigerant are let down to the same or approximately the same pressure and are mixed as they pass through and are warmed in the various heat exchanger sections, so as to form a single warm stream that is introduced into a shared compressor for recompression. The liquefied natural gas feed stream is subjected to various flash stages to further cool the natural gas in order to obtain an LNG product.

Nevertheless, there remains a need in the art for methods and systems for liquefying natural gas that utilize refrigeration cycles with high process efficiency that are suitable for use in FLNG applications, peak shaving facilities, and other scenarios where two-phase flow of refrigerant and separation of two-phase refrigerant is not preferred, maintenance of a large inventory of flammable refrigerant may be problematic, large quantiles of pure nitrogen or other required refrigerant components may be unavailable or difficult to obtain, and/or the available footprint for the plant places restrictions on the size of the heat exchangers, compressors, expanders and pipes that can be used in the refrigeration circuit.

BRIEF SUMMARY

Disclosed herein are methods and systems for the liquefaction of a natural gas feed stream to produce an LNG product The methods and systems use a refrigeration circuit that circulates a refrigerant comprising methane or a mixture of methane and nitrogen. The refrigeration circuit includes one or more turbo-expanders that are used to expand one or more gaseous streams of the refrigerant to provide one or more cold streams of gaseous (or at least predominantly gaseous) refrigerant that are used to provide refrigeration for liquefying and/or precooling the natural gas, and a J-T valve that is used to expand a liquid or two-phase stream of the refrigerant to provide a cold stream of vaporizing refrigerant that provides refrigeration for sub-cooling the natural gas, wherein said cold stream of vaporizing refrigerant is at a lower pressure than one or more of said cold streams of gaseous (or at least predominantly gaseous) refrigerant. Such methods and systems provide for the production of an LNG product utilizing a refrigeration cycle with high process efficiency, that uses a refrigerant (methane) that is available on-site, and in which the majority of the refrigerant remains in gaseous form throughout the refrigeration cycle.

Several preferred aspects of the systems and methods according to the present invention are outlined below.

Aspect 1: A method for liquefying a natural gas feed stream to produce an LNG product, the method comprising:

passing a natural gas feed stream through and cooling the natural gas feed stream in the warm side of some or all of a plurality of heat exchanger sections so as to liquefy and subcool the natural gas feed stream, the plurality of heat exchanger sections comprising a first heat exchanger section in which a natural gas stream is liquefied and a second heat exchanger section in which the liquefied natural gas stream from the first heat exchanger section is subcooled, the liquefied and subcooled natural gas stream being withdrawn from the second heat exchanger section to provide an LNG product; and circulating a refrigerant, comprising methane or a mixture of methane and nitrogen, in a refrigeration circuit comprising the plurality of heat exchanger sections, a compressor train comprising a plurality of compressors and/or compression stages and one or more intercoolers and/or aftercoolers, a first turbo-expander and a first J-T valve, wherein the circulating refrigerant provides refrigeration to each of the plurality of heat exchanger sections and thus cooling duty for liquefying and subcooling the natural gas feed stream, and wherein circulating the refrigerant in the refrigerant circuit comprises the steps of:

(i) splitting a compressed and cooled gaseous stream of the refrigerant to form a first stream of cooled gaseous refrigerant and a second stream of cooled gaseous refrigerant;

(ii) expanding the first stream of cooled gaseous refrigerant down to a first pressure in the first turbo-expander to form a first stream of expanded cold refrigerant at a first temperature and said first pressure, the first stream of expanded cold refrigerant being a gaseous or predominantly gaseous stream containing no or substantially no liquid as it exits the first turbo-expander;

(iii) passing the second stream of cooled gaseous refrigerant through and cooling the second stream of cooled gaseous refrigerant in the warm side of at least one of the plurality of heat exchanger sections, at least a portion of the second stream of cooled gaseous refrigerant being cooled and at least partially liquefied to form a liquid or two-phase stream of refrigerant;

(iv) expanding the liquid or two-phase stream of refrigerant down to a second pressure by throttling said stream through the first J-T valve to form a second stream of expanded cold refrigerant at a second temperature and said second pressure, the second stream of expanded cold refrigerant being a two-phase stream as it exits the J-T valve, the second pressure being lower than the first pressure and the second temperature being lower than the first temperature;

(v) passing the first stream of expanded cold refrigerant through and warming the first stream of expanded cold refrigerant in the cold side of at least one of the plurality of heat exchanger sections, comprising at least the first heat exchanger section and/or a heat exchanger section in which a natural gas stream is precooled and/or a heat exchanger section in which all or part of the second stream of cooled gaseous refrigerant is cooled, and passing the second stream of expanded cold refrigerant through and warming the second stream of expanded cold refrigerant in the cold side at least one of the plurality of heat exchanger sections, comprising at least the second heat exchanger section, wherein the first and second streams of expanded cold refrigerant are kept separate and not mixed in the cold sides of any of the plurality of heat exchanger sections, the first stream of expanded cold refrigerant being warmed to form all or part of a first stream of warmed gaseous refrigerant and the second stream of expanded cold refrigerant being warmed and vaporized to form all or part of a second stream of warmed gaseous refrigerant; and (vi) introducing the first stream of warmed gaseous refrigerant and the second stream of warmed gaseous refrigerant into the compressor train, whereby the second stream of warmed gaseous refrigerant is introduced into compressor train at a different, lower pressure location of the compressor train than the first stream of warmed gaseous refrigerant, and compressing, cooling and combining the first stream of warmed gaseous refrigerant and second stream of warmed gaseous refrigerant to form the compressed and cooled gaseous stream of the refrigerant that is then split in step (i).

Aspect 2: The method of Aspect 1, wherein the refrigerant comprises 25-65 mole % nitrogen and 30-80 mole % methane.

Aspect 3: The method of Aspect 1 or 2, wherein the first stream of expanded cold refrigerant has a vapor fraction of greater than 0.95 as it exits the first turbo-expander, and the second stream of expanded cold refrigerant has a vapor fraction of 0.02 to 0.1 as it exits the J-T valve.

Aspect 4: The method of any one of Aspects 1 to 3, wherein the ratio of refrigerant that provides evaporative refrigeration is from 0.02 to 0.2, the ratio of refrigerant that provides evaporative refrigeration being defined as the total molar flow rate of all liquid or two-phase streams of refrigerant in the refrigeration circuit that are expanded through J-T valves to form streams of expanded cold two-phase refrigerant that are warmed and vaporized in one or more of the plurality of heat exchanger sections, divided by the total molar flow rate of all of the refrigerant circulating in the refrigeration circuit.

Aspect 5: The method of any one of Aspects 1 to 4, wherein the pressure ratio of the first pressure to the second pressure is from 1.5:1 to 2.5:1.

Aspect 6: The method of any one of Aspects 1 to 5, wherein the liquefied and subcooled natural gas stream is withdrawn from the second heat exchanger section at a temperature of −130 to −155° C.

Aspect 7: The method of any one of Aspects 1 to 6, wherein the refrigeration circuit is a closed-loop refrigeration circuit.

Aspect 8: The method of any one of Aspects 1 to 7, wherein the first heat exchanger section is a coil wound heat exchanger section comprising a tube bundle having tube-side and a shell side.

Aspect 9: The method of any one of Aspects 1 to 8, wherein second heat exchanger section is a coil wound heat exchanger section comprising a tube bundle having tube-side and a shell side.

Aspect 10: The method of any one of Aspects 1 to 9, wherein the plurality of heat exchanger sections further comprise a third heat exchanger section in which a natural gas stream is precooled prior to being liquefied in the first heat exchanger section.

Aspect 11: The method of Aspect 10, wherein:

the refrigeration circuit further comprises a second turbo-expander;

step (iii) of circulating the refrigerant in the refrigeration circuit comprises passing the second stream of cooled gaseous refrigerant through and cooling the second stream of cooled gaseous refrigerant in the warm side of at least one of the plurality of heat exchanger sections, splitting the resulting further cooled second stream of cooled gaseous refrigerant to form a third stream of cooled gaseous refrigerant and fourth stream of cooled gaseous refrigerant, and passing the fourth stream of cooled gaseous refrigerant through and further cooling and at least partially liquefying the fourth stream of cooled gaseous refrigerant in the warm side of at least another one of the plurality of heat exchanger sections to form the liquid or two-phase stream of refrigerant;

circulating the refrigerant in the refrigeration circuit further comprises the step of expanding the third stream of cooled gaseous refrigerant down to a third pressure in the second turbo-expander to form a third stream of expanded cold refrigerant at a third temperature and said third pressure, the third stream of expanded cold refrigerant being a gaseous or predominantly gaseous stream containing no or substantially no liquid as it exits the second turbo-expander, the third temperature being lower than the first temperature but higher than the second temperature; and step (v) of circulating the refrigerant in the refrigeration circuit comprises passing the first stream of expanded cold refrigerant through and warming the first stream of expanded cold refrigerant in the cold side of at least one of the plurality of heat exchanger sections, comprising at least the third heat exchanger section and/or a heat exchanger section in which all or a part of the second stream of cooled gaseous refrigerant is cooled, passing the third stream of expanded cold refrigerant through and warming the third stream of expanded cold refrigerant in the cold side of at least one of the plurality of heat exchanger sections, comprising at least the first heat exchanger section and/or a heat exchanger section in which all or a part of the fourth stream of cooled gaseous refrigerant is further cooled, and passing the second stream of expanded cold refrigerant through and warming the second stream of expanded cold refrigerant in the cold side of at least one of the plurality of heat exchanger sections, comprising at least the second heat exchanger section, wherein the first and second streams of expanded cold refrigerant are kept separate and not mixed in the cold sides of any of the plurality of heat exchanger sections, the first stream of expanded cold refrigerant being warmed to form all or part of a first stream of warmed gaseous refrigerant and the second stream of expanded cold refrigerant being warmed and vaporized to form all or part a second stream of warmed gaseous refrigerant.

Aspect 12: The method of Aspect 11, wherein the third pressure is the substantially the same as the second pressure, and wherein the second stream of expanded cold refrigerant and third stream of expanded cold refrigerant are mixed and warmed in the cold side of at least one of the plurality of heat exchanger sections, the second and third streams of expanded cold refrigerant being mixed and warmed to form the second stream of warmed gaseous refrigerant.

Aspect 13: The method of Aspect 12, wherein the third stream of expanded cold refrigerant passes through and is warmed in the cold side of at least the first heat exchanger section, and wherein the second stream of expanded cold refrigerant passes through and is warmed in the cold side of at least the second heat exchanger section and then passes through and is further warmed in the cold side of at least the first heat exchanger section where it mixes with the third stream of expanded cold refrigerant.

Aspect 14: The method of Aspect 13, wherein the first heat exchanger section is a coil wound heat exchanger section comprising a tube bundle having tube-side and a shell side, and the second heat exchanger section is a coil wound heat exchanger section comprising a tube bundle having tube-side and a shell side.

Aspect 15: The method of Aspect 14, wherein said tube bundles of the first and second heat exchanger sections are contained within the same shell casing.

Aspect 16: The method of any one of Aspects 13 to 15, wherein the third heat exchanger section has a cold side that defines a plurality of separate passages through the heat exchanger section, and wherein the first stream of expanded cold refrigerant passes through and is warmed in at least one of said passages to form the first stream of warmed gaseous refrigerant, and a mixed stream of the second and third streams of expanded cold refrigerant from the first heat exchanger section passes through and is further warmed in at least one or more other of said passages to form the second stream of warmed gaseous refrigerant.

Aspect 17: The method of any one of Aspects 13 to 15, wherein the third heat exchanger section is a coil wound heat exchanger section comprising a tube bundle having tube-side and a shell side, the plurality of heat exchanger sections further comprise a fourth heat exchanger section in which a natural gas stream is precooled and/or in which all or a part of the second stream of cooled gaseous refrigerant is cooled, and the first stream of expanded cold refrigerant passes through and is warmed in the cold side of one of the third and fourth heat exchanger sections to form the first stream of warmed gaseous refrigerant and a mixed stream of the second and third streams of expanded cold refrigerant from the first heat exchanger section passes through and is further warmed in the cold side of the other of the third and fourth heat exchanger sections to form the second stream of warmed gaseous refrigerant.

Aspect 18: The method of Aspect 11, wherein the third pressure is the substantially the same as the first pressure, and wherein the third stream of expanded cold refrigerant and first stream of expanded cold refrigerant are mixed and warmed in the cold side of at least one of the plurality of heat exchanger sections, the third and first streams of expanded cold refrigerant being mixed and warmed to form the first stream of warmed gaseous refrigerant.

Aspect 19: The method of Aspect 18, wherein the first stream of expanded cold refrigerant passes through and is warmed in the cold side of at least the third heat exchanger section, and wherein the third stream of expanded cold refrigerant passes through and is warmed in the cold side of at least the first heat exchanger section and then passes through and is further warmed in the cold side of at least the third heat exchanger section where it mixes with the first stream of expanded cold refrigerant.

Aspect 20: The method of Aspect 19, wherein the first heat exchanger section is a coil wound heat exchanger section comprising a tube bundle having tube-side and a shell side, and the third heat exchanger section is a coil wound heat exchanger section comprising a tube bundle having tube-side and a shell side.

Aspect 21: The method of Aspect 20, wherein said tube bundles of the first and third heat exchanger sections are contained within the same shell casing.

Aspect 22: The method of any one of Aspects 18 to 21, wherein the plurality of heat exchanger sections further comprise a fourth heat exchanger section in which a natural gas stream is precooled and/or in which all or a part of the second stream of cooled gaseous refrigerant is cooled, and a fifth heat exchanger section in which a natural gas stream is liquefied and/or in which all or a part of the fourth stream or a fifth stream of cooled gaseous refrigerant is further cooled, wherein said fifth stream of cooled gaseous refrigerant, where present, is formed from another portion of the further cooled second stream of cooled gaseous refrigerant, and wherein the second stream of expanded cold refrigerant, after passing through and being warmed in the cold side of the second heat exchanger section, is passed through and is further warmed in the cold side of at least the fifth heat exchanger section and then the fourth heat exchanger section.

Aspect 23: The method of any one of Aspects 11 to 22, wherein the third stream of expanded cold refrigerant has a vapor fraction of greater than 0.95 as it exits the second turbo-expander.

Aspect 24: A system for liquefying a natural gas feed stream to produce an LNG product, the system comprising a refrigeration circuit for circulating a refrigerant, the refrigerant circuit comprising:

a plurality of heat exchanger sections, each of the heat exchanger sections having a warm side and a cold side, the plurality of heat exchanger sections comprising a first heat exchanger section and a second heat exchanger section, wherein the warm side of the first heat exchanger section defines at least one passage therethrough for receiving, cooling and liquefying a natural gas stream, wherein the warm side of the second heat exchanger section having defines at least one passage therethrough for receiving and subcooling a liquefied natural gas stream from the from the first heat exchanger section to as to provide an LNG product, and wherein the cold side of each of the plurality of heat exchanger sections defines at least one passage therethrough for receiving and warming an expanded stream of the circulating refrigerant that provides refrigeration to the heat exchanger section;

a compressor train, comprising a plurality of compressors and/or compression stages and one or more intercoolers and/or aftercoolers, for compressing and cooling the circulating refrigerant, wherein the refrigeration circuit is configured such that the compressor train receives a first stream of warmed gaseous refrigerant and a second stream of warmed gaseous refrigerant from the plurality of heat exchanger sections, the second stream of warmed gaseous refrigerant being received at and introduced into a different, lower pressure location of the compressor train than the first stream of warmed gaseous refrigerant, the compressor train being configured to compress, cool and combine the first stream of warmed gaseous refrigerant and second stream of warmed gaseous refrigerant to form a compressed and cooled gaseous stream of the refrigerant;

a first turbo-expander configured to receive and expand a first stream of cooled gaseous refrigerant down to a first pressure to form a first stream of expanded cold refrigerant at a first temperature and said first pressure; and a first J-T valve configured to receive and expand a liquid or two-phase stream of refrigerant down to a second pressure by throttling said stream to form a second stream of expanded cold refrigerant at a second temperature and said second pressure, the second pressure being lower than the first pressure and the second temperature being lower than the first temperature;

wherein the refrigerant circuit is further configured so as to:

split the compressed and cooled gaseous stream of the refrigerant from the compressor train to form the first stream of cooled gaseous refrigerant and a second stream of cooled gaseous refrigerant;

pass the second stream of cooled gaseous refrigerant through and cool the second stream of cooled gaseous refrigerant in the warm side of at least one of the plurality of heat exchanger sections, at least a portion of the second stream of cooled gaseous refrigerant being cooled and at least partially liquefied to form the liquid or two-phase stream of refrigerant; and pass the first stream of expanded cold refrigerant through and warm the first stream of expanded cold refrigerant in the cold side of at least one of the plurality of heat exchanger sections, comprising at least the first heat exchanger section and/or a heat exchanger section in which a natural gas stream is precooled and/or a heat exchanger section in which all or part of the second stream of cooled gaseous refrigerant is cooled, and pass the second stream of expanded cold refrigerant through and warm the second stream of expanded cold refrigerant in the cold side at least one of the plurality of heat exchanger sections, comprising at least the second heat exchanger section, wherein the first and second streams of expanded cold refrigerant are kept separate and not mixed in the cold sides of any of the plurality of heat exchanger sections, the first stream of expanded cold refrigerant being warmed to form all or part of the first stream of warmed gaseous refrigerant and the second stream of cold refrigerant being warmed and vaporized to form all or part of the second stream of warmed gaseous refrigerant.

Aspect 25: A system according to Aspect 24, wherein:

the plurality of heat exchanger sections further comprise a third heat exchanger section, wherein the warm side of the third heat exchanger section defines at least one passage therethrough for receiving and precooling a natural gas stream prior to said stream being received and further cooled and liquefied in the first heat exchanger section the refrigeration circuit further comprises a second turbo-expander configured to receive and expand a third stream of cooled gaseous refrigerant down to a third pressure to form a third stream of expanded cold refrigerant at a third temperature and said third pressure, the third temperature being lower than the first temperature but higher than the second temperature; and the refrigerant circuit is further configured so as to:

pass the second stream of cooled gaseous refrigerant through and cool the second stream of cooled gaseous refrigerant in the warm side of at least one of the plurality of heat exchanger sections, split the resulting further cooled second stream of cooled gaseous refrigerant to form the third stream of cooled gaseous refrigerant and a fourth stream of cooled gaseous refrigerant, and pass the fourth stream of cooled gaseous refrigerant through and further cool and at least partially liquefy the fourth stream of cooled gaseous refrigerant in the warm side of at least another one of the plurality of heat exchanger sections to form the liquid or two-phase stream of refrigerant; and pass the first stream of expanded cold refrigerant through and warm the first stream of expanded cold refrigerant in the cold side of at least one of the plurality of heat exchanger sections, comprising at least the third heat exchanger section and/or a heat exchanger section in which all or a part of the second stream of cooled gaseous refrigerant is cooled, pass the third stream of expanded cold refrigerant through and warm the third stream of expanded cold refrigerant in the cold side of at least one of the plurality of heat exchanger sections, comprising at least the first heat exchanger section and/or a heat exchanger section in which all or a part of the fourth stream of cooled gaseous refrigerant is further cooled, and pass the second stream of expanded cold refrigerant through and warm the second stream of expanded cold refrigerant in the cold side of at least one of the plurality of heat exchanger sections, comprising at least the second heat exchanger section, wherein the first and second streams of expanded cold refrigerant are kept separate and not mixed in the cold sides of any of the plurality of heat exchanger sections, the first stream of expanded cold refrigerant being warmed to form all or part of the first stream of warmed gaseous refrigerant and the second stream of expanded cold refrigerant being warmed and vaporized to form all or part the second stream of warmed gaseous refrigerant.

DETAILED DESCRIPTION

Figure 1:
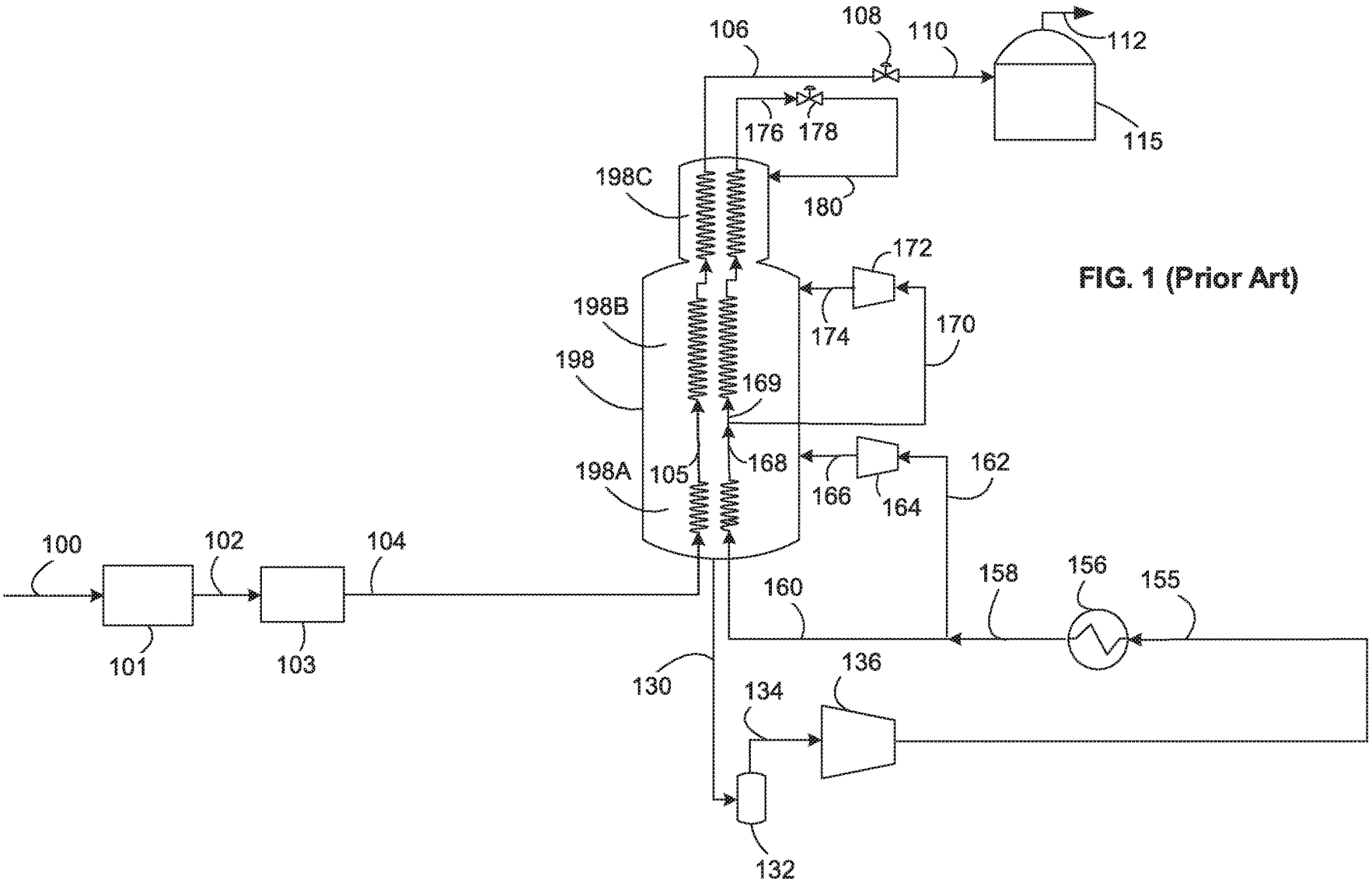
FIG. 1 (Prior Art)
FIG. 1 is a schematic flow diagram depicting a natural gas liquefaction method and system in accordance with the prior art.

Described herein are methods and systems for liquefying a natural gas that are particularly suitable and attractive for Floating LNG (FLNG) applications, peak shaving applications, modular liquefaction facilities, small scale facilities, and/or any other applications in which: high process efficiency is desired; two-phase flow of refrigerant and separation of two-phase refrigerant is not preferred; maintenance of a large inventory of flammable refrigerant is problematic; large quantiles of pure nitrogen or other required refrigerant components are unavailable or difficult to obtain; and/or the available footprint for the plant places restrictions on the size of the heat exchangers, compressors, expanders and pipes that can be used in the refrigeration system.

As used herein and unless otherwise indicated, the articles "a" and "an" mean one or more when applied to any feature in embodiments of the present invention described in the specification and claims. The use of "a" and "an" does not limit the meaning to a single feature unless such a limit is specifically stated. The article "the" preceding singular or plural nouns or noun phrases denotes a particular specified feature or particular specified features and may have a singular or plural connotation depending upon the context in which it is used.

Where letters are used herein to identify recited steps of a method (e.g. (a), (b), and (c)), these letters are used solely to aid in referring to the method steps and are not intended to indicate a specific order in which claimed steps are performed, unless and only to the extent that such order is specifically recited.

Where used herein to identify recited features of a method or system, the terms "first", "second", "third" and so on, are used solely to aid in referring to and distinguishing between the features in question, and are not intended to indicate any specific order of the features, unless and only to the extent that such order is specifically recited.

As used herein, the terms "natural gas" and "natural gas stream" encompass also gases and streams comprising synthetic and/or substitute natural gases. The major component of natural gas is methane (which typically comprises at least 85 mole %, more often at least 90 mole %, and on average about 95 mole % of the feed stream). Natural gas may also contain smaller amounts of other, heavier hydrocarbons, such as ethane, propane, butanes, pentanes, etc. Other typical components of raw natural gas include one or more components such as nitrogen, helium, hydrogen, carbon dioxide and/or other acid gases, and mercury. However, the natural gas feed stream processed in accordance with the present invention will have been pre-treated if and as necessary to reduce the levels of any (relatively) high freezing point components, such as moisture, acid gases, mercury and/or heavier hydrocarbons, down to such levels as are necessary to avoid freezing or other operational problems in the heat exchanger section or sections in which the natural gas is to be liquefied and subcooled.

As used herein, the term "refrigeration cycle" refers the series of steps that a circulating refrigerant undergoes in order to provide refrigeration to another fluid, and the term "refrigeration circuit" refers to the series of connected devices in which the refrigerant circulates and that carry out the aforementioned steps of the refrigeration cycle. In the methods and systems described herein, the refrigeration circuit comprises a plurality of heat exchanger sections, in which the circulating refrigerant is warmed to provide refrigeration, a compressor train comprising a plurality of compressors and/or compression stages and one or more intercoolers and/or aftercoolers, in which the circulating refrigerant is compressed and cooled, and at least one turbo-expander and at least one J-T valve, in which the circulating refrigerant is expanded to provide a cold refrigerant for supply to the plurality of heat exchanger sections.

As used herein, the term "heat exchanger section" refers to a unit or a part of a unit in which indirect heat exchange is taking place between one or more streams of fluid flowing through the cold side of the heat exchanger and one or more streams of fluid flowing through the warm side of the heat exchanger, the stream(s) of fluid flowing through the cold side being thereby warmed, and the stream(s) of fluding flowing the warm side being thereby cooled.

As used herein, the term "indirect heat exchange" refers to heat exchange between two fluids where the two fluids are kept separate from each other by some form of physical barrier.

As used herein, the term "warm side" as used to refer to part of a heat exchanger section refers to the side of the heat exchanger through which the stream or streams of fluid pass that are to be cooled by indirect heat exchange with the fluid flowing through the cold side. The warm side may define a single passage through the heat exchanger section for receiving a single stream of fluid, or more than one passage through the heat exchanger section for receiving multiple streams of the same or different fluids that are kept separate from each other as they pass through the heat exchanger section.

As used herein, the term "cold side" as used to refer to part of a heat exchanger section refers to the side of the heat exchanger through which the stream or streams of fluid pass that are to be warmed by indirect heat exchange with the fluid flowing through the warm side. The cold side may comprise a single passage through the heat exchanger section for receiving a single stream of fluid, or more than one passage through the heat exchanger section for receiving multiple streams of fluid that are kept separate from each other as they pass through the heat exchanger section.

As used herein, the term "coil wound heat exchanger" refers to a heat exchanger of the type known in the art, comprising one or more tube bundles encased in a shell casing, wherein each tube bundle may have its own shell casing, or wherein two or more tube bundles may share a common shell casing. Each tube bundle may represent a "coil wound heat exchanger section", the tube side of the bundle representing the warm side of said section and defining one or more than one passage through the section, and the shell side of the bundle representing the cold side of said section defining a single passage through the section. Coil wound heat exchangers are a compact design of heat exchanger known for their robustness, safety, and heat transfer efficiency, and thus have the benefit of providing highly efficient levels of heat exchange relative to their footprint. However, because the shell side defines only a single passage through the heat exchanger section, it is not possible use more than one stream of refrigerant in the cold side (shell side) of each coil wound heat exchanger section without said streams of refrigerant mixing in the cold side of said heat exchanger section.

As used herein, the term "turbo-expander" refers to a centrifugal, radial or axial-flow turbine, in and through which a gas is work-expanded (expanded to produce work) thereby lowering the pressure and temperature of the gas. Such devices are also referred to in the art as expansion turbines. The work produced by the turbo-expander may be used for any desired purpose. For example, it may be used to drive a compressor (such as one or more compressors or compression stages of the refrigerant compressor train) and/or to drive a generator.

As used herein, the term "J-T" valve or "Joule-Thomson valve" refers to a valve in and through which a fluid is throttled, thereby lowering the pressure and temperature of the fluid via Joule-Thomson expansion.

As used herein, the terms "closed-loop cycle", "closed-loop circuit" and the like refer to a refrigeration cycle or circuit in which, during normal operation, refrigerant is not removed from the circuit or added to the circuit (other than to compensate for small unintentional losses such as through leakage or the like). As such, in a closed-loop refrigeration circuit if the fluids being cooled in the warm side of any of the heat exchanger sections comprise both a refrigerant stream and a stream of natural gas that is to be precooled, liquefied and/or subcooled, said refrigerant stream and natural gas stream will be passed through separate passages in the warm side(s) of said heat exchanger section(s) such that said streams are kept separate and do not mix.

As used herein, the term "open-loop cycle", "open-loop circuit" and the like refer to a refrigerant cycle or circuit in which the feed stream that is to be liquefied, i.e. natural gas, also provides the circulating refrigerant, whereby during normal operation refrigerant is added to and removed from the circuit on a continuous basis. Thus, for example, in an open-loop cycle a natural gas stream may be introduced into the open-loop circuit as a combination of natural gas feed and make-up refrigerant, which natural gas stream is then combined with stream of warmed gaseous refrigerant to from the heat exchanger sections to form a combined stream that may then be compressed and cooled in the compressor train to form the compressed and cooled gaseous stream of refrigerant, a portion of which is subsequently split off to form the natural gas feed stream that is to be liquefied.

Solely by way of example, certain prior art arrangements and exemplary embodiments of the invention will now be described with reference to FIGS. 1 to 8. In these Figures, where a feature is common to more than one Figure that feature has been assigned the same reference numeral in each Figure, for clarity and brevity.

Referring now to FIG. 1, a natural gas liquefaction method and system in accordance with the prior art is shown. A raw natural gas feed stream 100 is optionally pretreated in a pretreatment system 101 to remove impurities such as mercury, water, acid gases, and heavy hydrocarbons and produce a pretreated natural gas feed stream 102, which may optionally be precooled in a precooling system 103 to produce a natural gas feed stream 104. The natural gas feed stream 104 is then liquefied and subcooled in a main cryogenic heat exchanger (MCHE) 198 to produce a first liquefied natural gas (LNG) stream 106. The MCHE 198 may be a coil wound heat exchanger as shown in FIG. 1, or it may be another type of heat exchanger such as a plate and fin or shell and tube heat exchanger. It may also consist of one or multiple sections. These sections be of the same or different types, and may by contained separate casings or a single casing. The MCHE 198, as shown in FIG. 1, consists of a third heat exchanger section 198A located at the warm end of the MCHE 198 (and also referred to herein as the warm section) in which the natural gas feed stream is pre-cooled, a first heat exchanger section 198B located in the middle of the MCHE 198 (and also referred to herein as the middle section) in which the precooled natural gas stream 105 from third section 198A is further cooled and liquefied, and a second heat exchanger section 198C at the cold end of the MCHE 198 (and also referred to herein as the cold section) in which the liquefied natural gas stream from the first section 198B is subcooled. Where the MCHE 198 is a coil wound heat exchanger, the sections may as depicted be tube bundles of the heat exchanger.

The subcooled LNG stream 106 exiting the cold section 198C is then letdown in pressure in a first LNG letdown valve 108 to produce a reduced pressure LNG product stream 110, which is sent to the LNG storage tank 115. Any boil-off gas (BOG) produced in the LNG storage tank is removed from the tank as BOG stream 112, which may be used as fuel in the plant, flared, and/or recycled to the feed.

Refrigeration to the MCHE 198 is provided by a refrigerant circulating in a refrigeration circuit comprising the sections 198A-C of the MCHE 198, a compressor train depicted in FIG. 1 as a compressor 136 and aftercooler 156, a first turbo-expander 164, a second turbo-expander 172, and a first J-T valve 178. A warm gaseous refrigerant stream 130 is withdrawn from the MCHE 198 and any liquid present in it during transient off-design operations, may be removed in a knock-out drum 132. The overhead warm gaseous refrigerant stream 134 is then compressed in compressor 136 to produce a compressed refrigerant stream 155 and cooled against ambient air or cooling water in a refrigerant aftercooler 156 to produce a compressed and cooled gaseous stream of refrigerant 158. The cooled compressed gaseous refrigerant stream 158 is then split into two streams, namely a first stream of cooled gaseous refrigerant 162 and a second stream of cooled gaseous refrigerant 160. The second stream 160 passes through and is cooled in the warm side of the warm section 198A of the MCHE 198, via a separate passage in said warm side to the passage through which the natural gas feed stream 104 is passed, to produce a further cooled second stream of cooled gaseous refrigerant 168, while the first stream 162 is expanded in the first turbo-expander 164 (also referred to herein as the warm expander) to produce a first stream of expanded cold refrigerant 166 that is passed through the cold side of warm section 198A of the MCHE 198 where it is warmed to provide refrigeration and cooling duty for precooling the natural gas feed stream 104 and cooling the second stream of cooled gaseous refrigerant 160.

The further cooled second stream of cooled gaseous refrigerant 168 is split into two further streams, namely a third stream of cooled gaseous refrigerant 170 and a fourth stream of cooled gaseous refrigerant 169. The fourth stream 169 is passed through and cooled in the warm sides of the middle section 198B and then the cold section 198C of the MCHE 198, via separate passages in said warm sides of said middle and cold sections 198B and 198C to the passages through which the natural gas feed stream 104/105 is passed, the fourth stream being at least partially liquefied in said middle and/or cold sections 198B and 198C to produce a liquid or two-phase stream of refrigerant 176. The third stream of cooled gaseous refrigerant 170 is expanded in the second turbo-expander 172 (also referred to herein as the cold expander) to produce a third stream of expanded cold refrigerant 174 that is passed through the cold side of the middle section 198B of the MCHE 198, where it is warmed to provide refrigeration and cooling duty for liquefying the precooled natural gas feed stream 105 and cooling the fourth stream of cooled gaseous refrigerant 169, and is then passed through and further warmed in the cold side of the warm section 198A of the MCHE 198 where it mixes with first stream of expanded cold refrigerant 166. The first and second streams of expanded cold refrigerant 166 and 174 are at least predominantly gaseous with a vapor fraction greater than 0.95 as they exit respectively the first and second turbo-expanders 164 and 172.

The liquid or two-phase stream of refrigerant 176 exiting the warm side of the cold section 198C of the MCHE 198 is let down in pressure via throttling in the first J-T valve 178 to produce a second stream of expanded cold refrigerant 180, which is two-phase in nature as it exits the J-T valve 178. The second stream of expanded cold refrigerant 180 is passed through the cold side of the cold section 198C of the MCHE 198, where it is warmed to provide refrigeration and cooling duty for subcooling the liquefied natural gas feed stream and cooling the fourth stream of cooled gaseous refrigerant, and is then passed through and further warmed in the cold side of the middle section 198B and warm section 198A of the MCHE 198 where it mixes with third stream of expanded cold refrigerant 174 and the first stream of expanded cold refrigerant 166.

Figure 2:
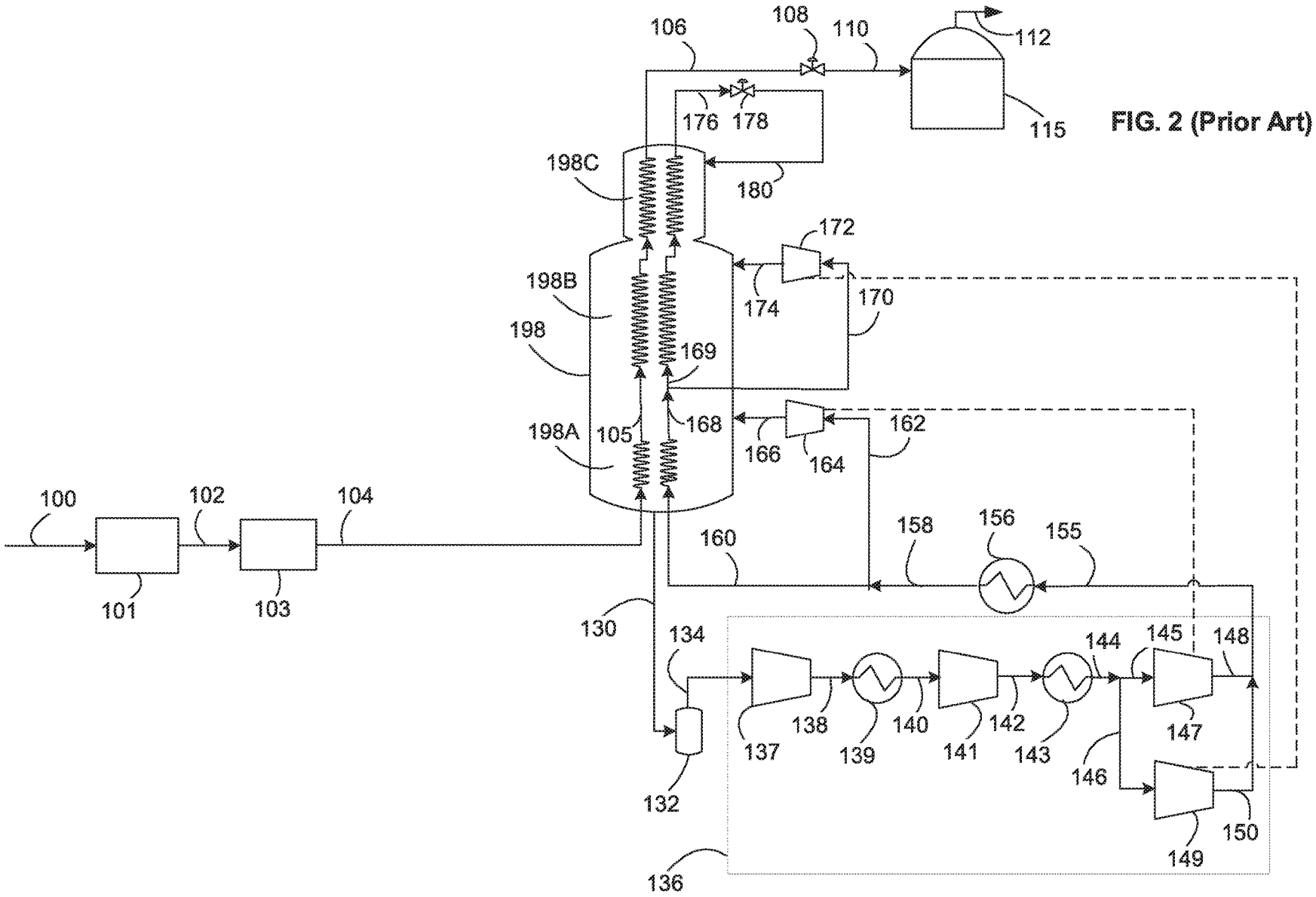
FIG. 2 (Prior Art)
FIG. 2 is a schematic flow diagram depicting a natural gas liquefaction method and system in accordance with the prior art.

FIG. 2 shows a preferred configuration of the compressor train of FIG. 1, in which compressor 136 is instead a compression system 136 comprising series of compressors or compression stages with intercoolers. The overhead warm gaseous refrigerant stream 134 is compressed in a first compressor 137 to produce a first compressed refrigerant stream 138, cooled against ambient air or cooling water in a first intercooler 139 to produce a first cooled compressed refrigerant stream 140, which is further compressed in a second compressor 141 to produce a second compressed refrigerant stream 142. The second compressed refrigerant stream 142 is cooled against ambient air or cooling water in a second intercooler 143 to produce a second cooled compressed refrigerant stream 144, which is split into two portions, a first portion 145 and a second portion 146. The first portion of the second cooled compressed refrigerant stream 145 is compressed in a third compressor 147 to produce a third compressed stream 148, while the second portion of the second cooled compressed refrigerant stream 146 is compressed in a fourth compressor 149 to produce a fourth compressed stream 150. The third compressed stream 148 and the fourth compressed stream 150 are mixed to produce the compressed refrigerant stream 155 that is then cooled in the refrigerant aftercooler 156 to produce the cooled compressed gaseous refrigerant stream 158.

The third compressor 147 may be driven at least partially by power generated by the warm expander 164, while the fourth compressor 149 may be driven at least partially by power generated by the cold expander 172, or vice versa. Equally, the warm and/or cold expanders could drive any of the other compressors in the compressor train. Although depicted in FIG. 2 as being separate compressors, two or more of the compressors in the compressor system could instead be compression stages of a single compressor unit. Equally, where one or more of the compressors are driven by one or more of the expanders, the associated compressors and expanders may be located in a single casing called a compressor-expander assembly or "compander".

A drawback of the prior art arrangements shown in FIGS. 1-2 is that the refrigerant provides cooling duty to the warm, middle, and cold sections at roughly the same pressure. This is because the cold streams mix at the top of the middle and warm sections, resulting in similar outlet pressures from the warm and cold expanders and the J-T valve. Any minor differences in these outlet pressures in the prior art configurations are due to the heat exchanger cold-side pressure drop across the cold, middle, and warm sections, which is typically less than about 45 psia (3 bara), preferably less than 25 psia (1.7 bara), and more preferably less than 10 psia (0.7 bara) for each section. This pressure drop varies based on the heat exchanger type. Therefore, the arrangements of the prior art do not provide the option of adjusting the pressures of the cold streams based on refrigeration temperature desired.

Figure 3:
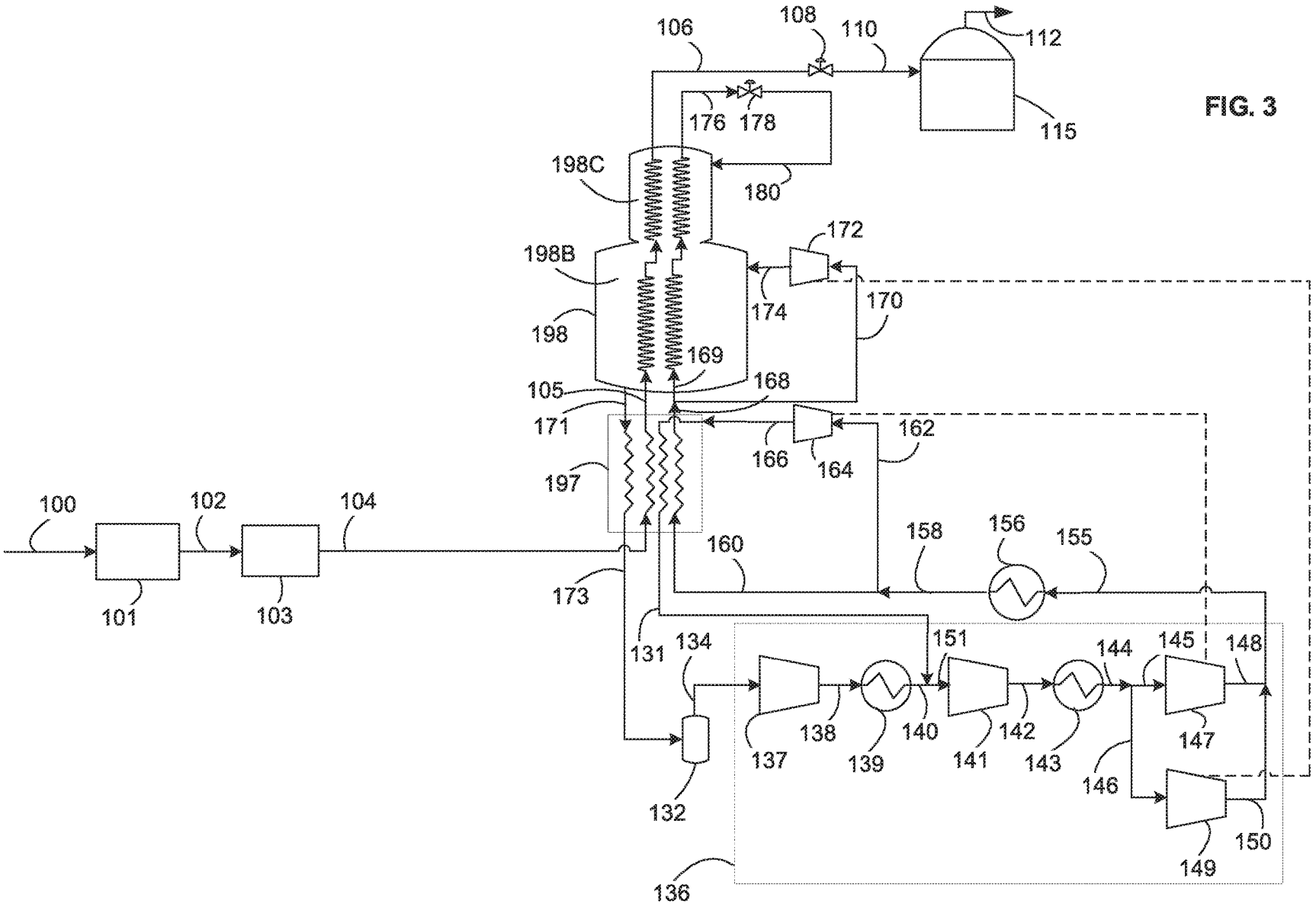
FIG. 3 is a schematic flow diagram depicting a natural gas liquefaction method and system in accordance with a first embodiment.

FIG. 3 shows a first exemplary embodiment. The MCHE 198 in this embodiment may be of any type, but again is preferably a coil-wound heat exchanger. In this case it has two heat exchanger sections (i.e. two tube bundles in the case where the MCHE is a coil wound heat exchanger), namely a first heat exchanger section 198B (equivalent to the middle section of the MCHE 198 in FIGS. 1 and 2) in which the precooled natural gas feed stream 105 is liquefied, and a second heat exchanger section 198C (equivalent to the cold section of the MCHE 198 in FIG. 1) in which the liquefied natural gas feed stream from the first heat exchanger section 198B is subcooled. In lieu of the warm section 198A of the MCHE 198 of FIGS. 1 and 2, in this embodiment the third heat exchanger section 197 in which the natural gas feed stream 104 is precooled is located in a separate unit, and is a plate and fin heat exchanger section (as shown) or any other suitable type of heat exchanger section known in the art that has a cold side that defines a plurality of separate passages through the heat exchanger section, allowing more than one stream of refrigerant to pass separately through the cold side of of said section without being mixed. Although the first and second heat exchanger sections 198B and 198C are depicted as being housed within the same shell casing, in an alternative arrangement each of these sections could be housed in its own shell casing. The inlets and outlets of the third heat exchanger section 197 may be located at the warm end, cold end, and/or at any intermediate location of the section.

A raw natural gas feed stream 100 is optionally pretreated in a pretreatment system 101 to remove impurities such as mercury, water, acid gases, and heavy hydrocarbons and produce a pretreated natural gas feed stream 102, which may optionally be precooled in a precooling system 103 to produce a natural gas feed stream 104. The precooling system 103 may comprise a closed or open loop cycle and may utilize any precooling refrigerant such as feed gas, propane, hydrofluorocarbons, mixed refrigerant, etc. The precooling system 103 may be absent in some cases.

The natural gas feed stream 104 is precooled (or further precooled) in the warm side of the third heat exchanger section 197 to produce a precooled natural gas stream 105, which is then liquefied in the warm side of the first heat exchanger section 198B and subcooled in the warm side of the second heat exchanger section 198C to produce a subcooled LNG stream 106 that exits the second heat exchanger section 198C and MCHE 198 at a temperature of about −130 degrees Celsius to about −155 degrees Celsius, and more preferably at a temperature of about −140 degrees Celsius to about −155 degrees Celsius. The LNG stream 106 exiting the MCHE 198 is letdown in pressure in a first LNG letdown device 108 to produce a reduced pressure LNG product stream 110, which is sent to the LNG storage tank 115. The first LNG letdown device 108 may be a J-T valve (as depicted in FIG. 3) or a hydraulic turbine (turbo-expander) or any other suitable device. Any BOG produced in the LNG storage tank is removed from the tank as BOG stream 112, which may be used as fuel in the plant, flared, and/or recycled to the feed.

Refrigeration to the third, first and second heat exchanger sections 197, 198B and 198C is provided by a refrigerant circulating in a closed-loop refrigeration circuit comprising: said heat exchanger sections 197, 198B, 198C; a compressor train comprising a compression system 136 (comprising compressors/compression stages 137, 141, 147, 149 and intercoolers 139, 143) and an aftercooler 156; a first turbo-expander 164; a second turbo-expander 172; and a first J-T valve 178.

A first stream of warmed gaseous refrigerant 131 and a second stream of warmed gaseous refrigerant 173 are withdrawn from the warm end of the third heat exchanger section 197 from separate passages in the cold side of said heat exchanger section, the second stream of warmed gaseous refrigerant 173 being at a lower pressure than the first stream of warmed gaseous refrigerant 131. The first stream of warmed gaseous refrigerant 131 may be sent to a knock-out drum (not shown) to remove any liquids that may be present in the stream during transient off-design operations, the first stream of warmed gaseous refrigerant 131 leaving the knock out drum as an overhead stream (not shown). The second stream of warmed gaseous refrigerant 173 may similarly be sent to another knock-out drum 132 to knock out any liquids present in it during transient off-design operations, the second stream of warmed gaseous refrigerant leaving the knock out drum as an overhead stream 134. The first stream of warmed gaseous refrigerant 131 and the second stream of warmed gaseous refrigerant 134 are then introduced into different locations of the compression system 136, the second stream of warmed gaseous refrigerant being introduced into the compression system at a lower pressure location than the first stream of warmed gaseous refrigerant.

In the refrigerant compression system 136, the second stream of warmed gaseous refrigerant 134 is compressed in a first compressor/compression stage 137 to produce a first compressed refrigerant stream 138, which is cooled against ambient air or cooling water in a first intercooler 139 to produce a first cooled compressed refrigerant stream 140. The first stream of warmed gaseous refrigerant 131 is mixed with the first cooled compressed refrigerant stream 140 to produce a mixed medium pressure refrigerant stream 151, which is further compressed in a second compressor 141 to produce a second compressed refrigerant stream 142. The second compressed refrigerant stream 142 is cooled against ambient air or cooling water in a second intercooler 143 to produce a second cooled compressed refrigerant stream 144, which is split into two portions, a first portion 145 and a second portion 146. The first portion of the second cooled compressed refrigerant stream 145 is compressed in a third compressor 147 to produce a third compressed stream 148, while the second portion of the second cooled compressed refrigerant stream 146 is compressed in a fourth compressor 149 to produce a fourth compressed stream 150. The third compressed stream 148 and the fourth compressed stream 150 are mixed to produce a compressed refrigerant stream 155.

The compressed refrigerant stream 155 is cooled against ambient air or cooling water in a refrigerant aftercooler 156 to produce a compressed and cooled gaseous stream of refrigerant 158. The cooled compressed gaseous refrigerant stream 158 is then split into two streams, namely a first stream of cooled gaseous refrigerant 162 and a second stream of cooled gaseous refrigerant 160. The second stream of cooled gaseous refrigerant 160 passes through and is cooled in the warm side of the third heat exchanger section 197, via a separate passage in said warm side to the passage through which the natural gas feed stream 104 is passed, to produce a further cooled second stream of cooled gaseous refrigerant 168. The first stream of cooled gaseous refrigerant 162 is expanded down to a first pressure in the first turbo-expander 164 (also referred to herein as the warm expander) to produce a first stream of expanded cold refrigerant 166 at a first temperature and said first pressure and that is at least predominantly gaseous having a vapor fraction greater than 0.95 as it exits the first turbo-expander. The first stream of expanded cold refrigerant 166 is passed through the cold side of the third heat exchanger section 197 where it is warmed to provide refrigeration and cooling duty for precooling the natural gas feed stream 104 and cooling the second stream of cooled gaseous refrigerant 160, the first stream of expanded cold refrigerant 166 being warmed to form the first stream of warmed gaseous refrigerant 131.

The further cooled second stream of cooled gaseous refrigerant 168 is split into two further streams, namely a third stream of cooled gaseous refrigerant 170 and a fourth stream of cooled gaseous refrigerant 169. The third stream of cooled gaseous refrigerant 170 is expanded down to a third pressure in the second turbo-expander 172 (also referred to herein as the cold expander) to produce a third stream of expanded cold refrigerant 174 at a third temperature and said third pressure and that is at least predominantly gaseous having a vapor fraction greater than 0.95 as it exits the second turbo-expander. The third temperature and the third pressure are each lower than, respectively, the first temperature and the first pressure. The fourth stream 169 is passed through and cooled in the warm side of the first heat exchanger section 198B and then the warm side of the second heat exchanger section 198C, via separate passages in said warm sides of said first and second heat exchanger sections 198B, 198C to the passages through which the natural gas feed stream 104/105 is passed, the fourth stream being at least partially liquefied in said first and/or section heat exchanger sections 198B, 198C to produce a liquid or two-phase stream of refrigerant 176. The liquid or two-phase stream of refrigerant 176 exiting the warm side of the third heat exchanger section 198C is let down in pressure to a second pressure via throttling in the first J-T valve 178 to produce a second stream of expanded cold refrigerant 180 at a second temperature and said second pressure and which is two-phase in nature as it exits the first J-T valve 178. In a preferred embodiment, the second stream of expanded cold refrigerant 180 has a vapor fraction between about 0.02 to about 0.1 as it exits the first J-T valve 178. The second temperature is lower than the third temperature (and thus is lower also than the first temperature). The second pressure is in this embodiment substantially the same as the third pressure.

The third stream of expanded cold refrigerant 174 is passed through the cold side of the first heat exchanger section 198B where it is warmed to provide refrigeration and cooling duty for liquefying the precooled natural gas feed stream 105 and cooling the fourth stream of cooled gaseous refrigerant 169. The second stream of expanded cold refrigerant 180 is passed through the cold side of the second heat exchanger section 198C, where it is warmed (at least partially vaporizing and/or warming the stream) to provide refrigeration and cooling duty for subcooling the liquefied natural gas feed stream and cooling the fourth stream of cooled gaseous refrigerant, and is then passed through and further warmed in the cold side of the first heat exchanger section 198B where it mixes with third stream of expanded cold refrigerant 174 and provides additional refrigeration and cooling duty for liquefying the precooled natural gas feed stream 105 and cooling the fourth stream of cooled gaseous refrigerant 169. The resulting mixed stream 171 (composed of the mixed and warmed second and third streams of expanded cold refrigerant) exiting the warm end of the cold side of the first heat exchanger section 198B is then passed through the cold side of the third heat exchanger section 197 where it is further warmed to provide additional refrigeration and cooling duty for precooling the natural gas feed stream 104 and cooling the second stream of cooled gaseous refrigerant 160, the mixed stream 171 being further warmed to form the second stream of warmed gaseous refrigerant 173, the mixed stream 171 being passed through a separate passage in the cold side of the third heat exchanger section 197 from the passage in the cold side through which the first stream of expanded cold refrigerant 166 is passed.

Cooling duty for the third heat exchanger section 197 is thus provided by at least two separate refrigerant streams that do not mix and are at different pressures, namely mixed stream 171 (composed of the mixed and warmed second and third streams of expanded cold refrigerant exiting the warm end of the cold side of the first heat exchanger section 198B) and the first stream of expanded cold refrigerant 166. They provide cooling duty to precool the natural gas feed stream 104 and cool the second stream of cooled gaseous refrigerant 160 to produce the precooled natural gas stream 105 and the further cooled second stream of cooled gaseous refrigerant 168, respectively, at a temperature between about −25 degrees Celsius and −70 degrees Celsius and preferably between about −35 degrees Celsius and −55 degrees Celsius.

The second stream of cooled gaseous refrigerant 160 is between about 40 mole % and 85 mole % of the cooled compressed gaseous refrigerant stream 158 and preferably between about 55 mole % and 75 mole % of the cooled compressed gaseous refrigerant stream 158. The fourth stream of cooled gaseous refrigerant 169 is between about 3 mole % and 20 mole % of the further cooled second stream of cooled gaseous refrigerant 168 and preferably between about 5 mole % and 15 mole % of the further cooled second stream of cooled gaseous refrigerant 168. The ratio of the molar flow rate of the liquid or two-phase stream of refrigerant 176 to the molar flow rate of the cooled compressed gaseous refrigerant stream 158 is typically between 0.02 and 0.2 and preferably between about 0.02 and 0.1. This ratio is the "ratio of refrigerant that provides evaporative refrigeration" for the embodiment depicted in FIG. 3, since it represents the total molar flow rate of all liquid or two-phase streams of refrigerant (liquid or two-phase stream of refrigerant 176) in the refrigeration circuit that are expanded through J-T valves (first J-T valve 178) to form streams of expanded cold two-phase refrigerant (second stream of expanded cold refrigerant 180) that are warmed and vaporized in one or more of the heat exchanger sections of the refrigeration circuit (198C, 198B, 197) divided by the total flow rate of all of the refrigerant circulating in the refrigeration circuit (this being the same as the flow rate of cooled compressed gaseous refrigerant stream 158).

As noted above, the second pressure (pressure of the second stream of expanded cold refrigerant 180 at the exit of the J-T valve 178) and the third pressure (pressure of the third stream of expanded cold refrigerant 174 at the exit of the second turbo-expander 172) are substantially the same and are each lower than the first pressure (pressure of the first stream of expanded cold refrigerant 166 at the exit of the first turbo-expander 164). Such differences in pressure as exist between the second and third pressures are as a result pressure drop across the second heat exchanger section 198C. For example, as the second stream of expanded cold refrigerant passes through the cold side of the second heat exchanger section it will typically drop in pressure very slightly, typically by less than 1 bar (e.g. by 1-10 psi (0.07-0.7 bar)), and consequently to allow the second and third streams of expanded cold refrigerant to be at the same pressure when they enter the cold side of the first heat exchanger section and are mixed the second pressure may need to be very slightly (typically less than 1 bar) higher than the third pressure. In a preferred embodiment, the pressure ratio of the first pressure to the second pressure is from 1.5:1 to 2.5:1. In a preferred embodiment, the pressure of the first stream of expanded cold refrigerant 166 is between about 10 bara and 35 bara, while the pressure of the third stream of expanded cold refrigerant 174 and the pressure of the second stream of expanded cold refrigerant 180 are between about 4 bara and 20 bara. Correspondingly, the second stream of warmed gaseous refrigerant 173 has a pressure between about 4 bara and 20 bara, while the first stream of warmed gaseous refrigerant 131 has a pressure between about 10 bara and 35 bara.

The third compressor 147 may be driven at least partially by power generated by the warm expander 164, while the fourth compressor 149 may be driven at least partially by power generated by the cold expander 172, or vice versa. Alternatively, any of the other compressors in the compression system could be driven at least partially by the warm expander and/or cold expander. The compressor and expander units may be located in one casing, referred to as a compressor-expander assembly or "compander". Any additional power required may be provided using an external driver, such as an electric motor or gas turbine. Using a compander lowers the plot space of the rotating equipment, and improves the overall efficiency.

The refrigerant compression system 136 shown in FIG. 3 is an exemplary arrangement, and several variations of the compression system and compressor train are possible. For instance, although depicted in FIG. 3 as being separate compressors, two or more of the compressors in the compression system could instead be compression stages of a single compressor unit. Equally, each compressor shown may comprise multiple compression stages in one or more casings. Multiple intercoolers and aftercoolers maybe present. Each compression stage may comprise one or more impellers and associated diffusers. Additional compressors/compression stages could be included, in series or parallel with any of the compressors shown, and/or one or more of the depicted compressors could be omitted. The first compressor 137, the second compressor 141, and any of the other compressors maybe driven by any kind of driver, such as an electric motor, industrial gas turbine, aero derivative gas turbine, steam turbine, etc. The compressors may be of any type, such as centrifugal, axial, positive displacement, etc.

In a preferred embodiment, the first stream of warmed gaseous refrigerant 131 may be introduced as a side-stream in a multi-stage compressor, such that the first compressor 137 and the second compressor 141 are multiple stages of a single compressor.

In another embodiment (not shown), the first stream of warmed gaseous refrigerant 131 and the second stream of warmed gaseous refrigerant 173 may be compressed in parallel in separate compressors and the compressed streams may be combined to produce the second compressed refrigerant stream 142.

The refrigerant circulating in the refrigeration circuit is a refrigerant that comprises methane or a mixture of methane and nitrogen. It may also comprise other refrigerant components, such as (but not limited to) carbon dioxide, ethane, ethylene, argon, to the extent that these do not affect the first and third expanded cold refrigerant streams being at least predominatly gaseous at the exit of, respectively, the first and second turbo-expanders, or affect the second expanded cold refrigerant stream being two-phase at the exit of the first J-T valve. In preferred embodiments, the refrigerant comprises a mixture or methane and nitrogen. A preferred nitrogen content of the cooled compressed refrigerant stream 158 is from about 20 mole % to 70 mole %, preferably from about 25 mole % to 65 mole % and more preferably from about 30 mole % to 60 mole % nitrogen. A preferred methane content of the cooled compressed refrigerant stream 158 is from about 30 mole % to 80 mole %, preferably from about 35 mole % to 75 mole %, and more preferably from about 40 mole % to 70 mole % methane.

In an variant of the embodiment depicted in FIG. 3, the system excludes the second turbo-expander 172 and thus uses only the first turbo-expander 164, that provides both precooling and liquefaction duty, and first J-T valve 172 that provides subcooling duty. In such a scenario, the heat exchanger section 198B is omitted. Refrigeration for the second heat exchanger section is provided by the J-T valve 178 (as in FIG. 3). The heat exchanger section 197 now acts as the first heat exchanger section and provides both precooling and liquefaction duty, refrigeration for which is provided by two cold streams at different pressures, namely: the second stream of expanded cold refrigerant (after being first warmed in the second heat exchanger section 198C) and the first stream of expanded cold refrigerant 166. In this embodiment, the second turbo-expander (cold expander) 172 is not present.

A key benefit of the embodiment shown in FIG. 3 over the prior art is that the pressure of the first stream of expanded cold refrigerant 166 is significantly different from the pressure(s) of the second and third streams of expanded cold refrigerant 180, 174. This enables the provision of cooling at a different pressure for the first and second heat exchanger sections 198B, 198C (the liquefaction and subcooling sections) than for the third heat exchanger section 197 (the precooling section). Lower refrigerant pressure is preferable for the liquefaction and, in particular, subcooling sections, and higher refrigerant pressure is preferable for the precooling section. By allowing the warm expander pressure to be significantly different from the cold expander and J-T valve pressure(s), the process results in higher overall efficiency. As a result, the warm expander 164 is used to primarily provide precooling duty, while the cold expander 172 is used to primarily provide liquefaction duty and the J-T valve 178 provides subcooling duty. Furthermore, by using coil wound heat exchanger sections for the liquefaction and subcooling sections 198B, 198C the benefits (i.e. compactness and high efficiency) of using this exchanger type for these sections can be retained; while by using for the precooling section 197 a heat exchanger section that is of a type that has a cold side that defines a plurality of separate passages through the heat exchanger section, further refrigeration can be recovered in the precooling section 197 from the mixed stream 171 of the second and third streams of expanded cold refrigerant without mixing said stream 171 with first stream of expanded cold refrigerant 166 that is at a different pressure and also passes through the cold side of the precooling section 197. The resulting second stream of warmed gaseous refrigerant 173 and first stream of warmed gaseous refrigerant stream 131 exiting the cold side of the precooling section 197 can then be sent to the refrigerant compression system 136 at two different pressures, with the lower pressure second stream of warmed gaseous refrigerant 173 being sent to a lower pressure location of the compression system, such as for example to the lowest pressure inlet of the refrigerant compression system 136, and the higher pressure first stream of warmed gaseous refrigerant 131 being sent to a higher pressure location of the compression system, for example as a side-stream into the refrigerant compression system 136, as previously discussed. A key advantage of such an arrangement is that it results in a compact system with higher process efficiency than the prior art processes.

Figure 4:
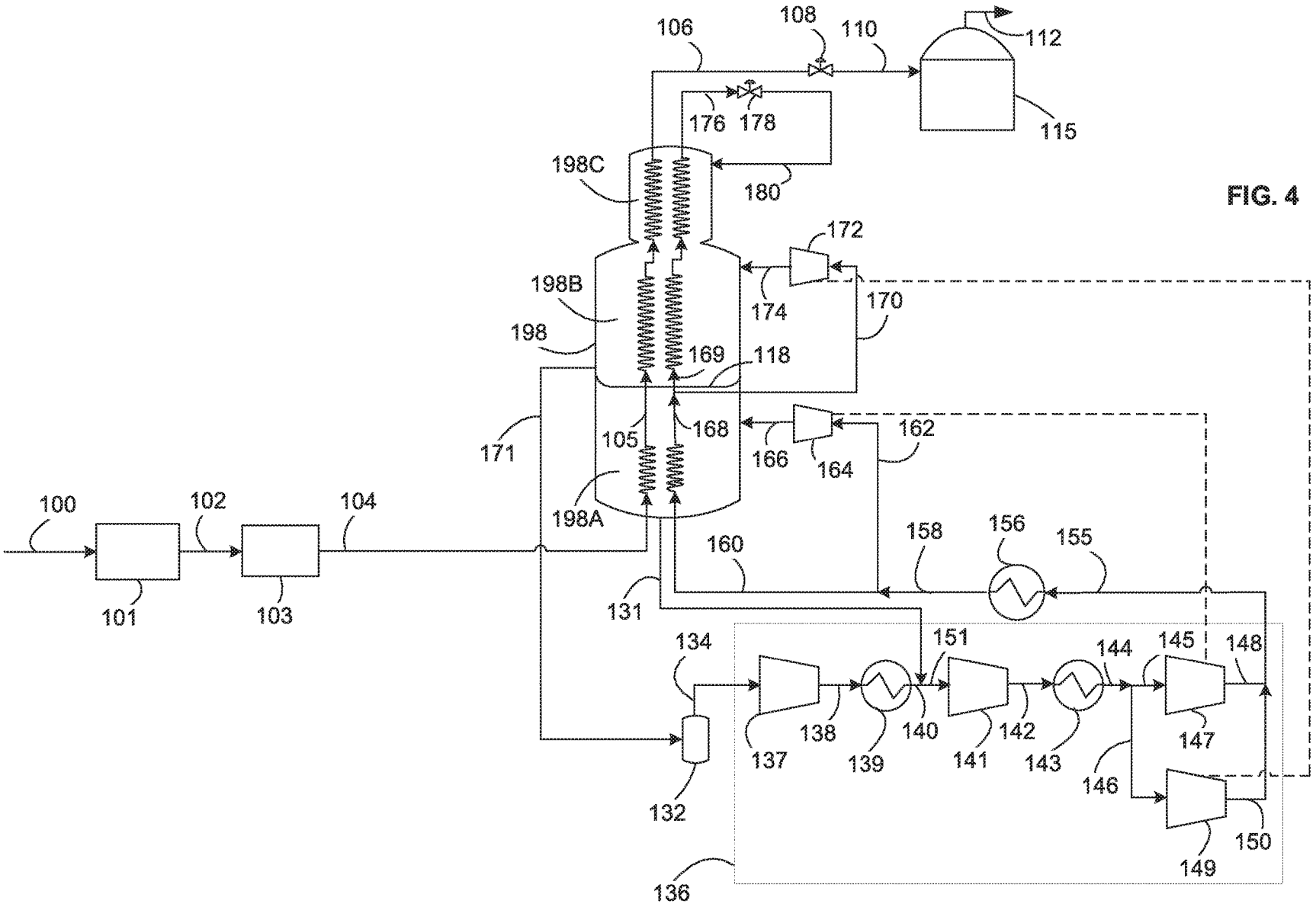
FIG. 4 is a schematic flow diagram depicting a natural gas liquefaction method and system in accordance with a second embodiment.

FIG. 4 shows a second embodiment and a variation of FIG. 3. In this embodiment, the MCHE 198 is again preferably a coil-wound heat exchanger, that in this case comprises the third heat exchanger section (the warm section/tube bundle) 198A, first heat exchanger section (the middle section/tube bundle) 198B, and second heat exchanger section (the cold section/tube bundle) 198C. However, in this case the MCHE 198 contains also a head 118 that separates the cold side (shell side) of the warm section 198A from the cold side (shell side) of the middle section 198B of the coil wound heat exchanger, preventing refrigerant in the cold sides of the cold and middle sections 198C, 198B from flowing into the cold side of the warm section 198A. The head 118 thus contains shell-side pressure and allows the cold side of the warm section 198A to be at a different shell-side pressure from the cold side of the middle and cold sections 198B, 198C. The mixed stream 171 of the second and third streams of expanded cold refrigerant 171 withdrawn from the warm end of the cold side of the middle section 198B is sent directly to the knock-out drum 132 for liquid removal, and thus in this arrangement the mixed stream 171 forms the second stream of warmed gaseous refrigerant that is compressed in the refrigerant compression system 136, no further refrigeration being recovered from the mixed stream 171 exiting the warm end of the cold side of the middle section 198B prior to compression. The temperature of the mixed stream 171 is between about −40 degrees Celsius and −70 degrees Celsius.

In a variant to the embodiment depicted in FIG. 4, two separate coil wound heat exchanger units may be used, wherein the third heat exchanger section (warm section) 198A is encased in its own shell casing, and the first heat exchanger section (middle section) 198B and second heat exchanger section (cold section) 198C share and are together incased in another shell casing. In such an arrangement, a head 118 is not required to separate the cold side (shell side) of the warm section 198A from the cold sides (shell side) of the middle section 198B and warm section 198C.

The embodiment depicted in FIG. 4 has a slightly lower process efficiency as compared to FIG. 3, since in FIG. 4 the second stream of warmed gaseous refrigerant that is compressed in the compression system 136 is the mixed stream 171 that is "cold compressed" or compressed at a colder temperature, whereas in FIG. 3 the mixed stream 171 is first further warmed in the third heat exchanger section 197 to form the second stream of warmed gaseous refrigerant thereby extracting further refrigeration from said stream prior to compression. However, the arrangement shown in FIG. 4 does have the benefit that it is still higher in process efficiency as compared to the prior art, and does results in a lower equipment count and footprint than FIG. 3. Since there is only one refrigerant stream (the first expanded refrigerant stream 166) that passes through the cold side of the third heat exchanger section 198A, a coil wound heat exchanger section can be used for this section which again provides benefits in terms of the heat transfer efficiency of the process and footprint of the plant.

Figure 5:
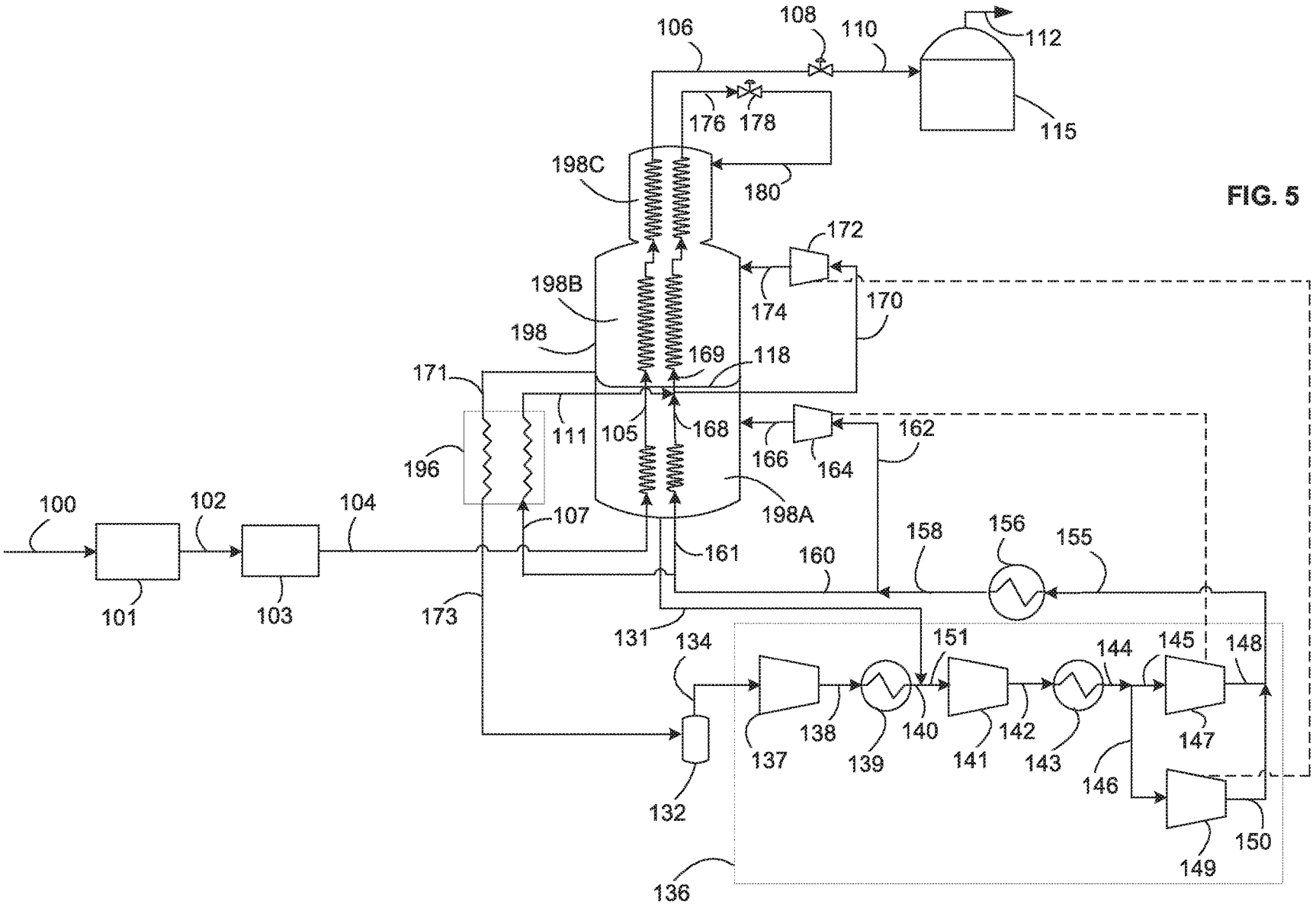
FIG. 5 is a schematic flow diagram depicting a natural gas liquefaction method and system in accordance with a third embodiment.

FIG. 5 shows a third embodiment and further variation of FIG. 4. The MCHE 198 is again preferably a coil-wound heat exchanger, that in this case comprises the third heat exchanger section (the warm section/tube bundle) 198A, first heat exchanger section (the middle section/tube bundle) 198B, and second heat exchanger section (the cold section/tube bundle) 198C, and the MCHE 198 again contains a head 118 that separates the cold side (shell side) of the warm section 198A from the cold side (shell side) of the middle section 198B, preventing refrigerant in the cold sides of the cold and middle sections 198C, 198B from flowing into the cold side of the warm section 198A. However, in this case the mixed stream 171 of the warmed second and third streams of expanded cold refrigerant withdrawn from the warm end of the cold side of the middle section 198B is not cold compressed. Instead, in the embodiment shown in FIG. 5 the refrigeration circuit further comprises a fourth heat exchanger section 196, and refrigeration is extracted from the mixed stream 171 of the warmed second and third streams of expanded cold refrigerant in said fourth heat exchanger section 196, the mixed stream 171 being passed through and warmed in the cold side of the fourth heat exchanger section 196 to produce the second stream of warmed gaseous refrigerant 173. The fourth heat exchanger section 196 may be a heat exchanger section of any suitable heat exchanger type, for example such as coil wound section, plate and fin section (as shown in FIG. 5) or shell and tube section.

In the embodiment depicted in FIG. 5, the second stream of cooled gaseous refrigerant 160 is also split into two portions, namely a first portion 161 and a second portion 107. The first portion is passed through and cooled in the warm side of the third heat exchanger section 198A to produce a first portion the further cooled second stream of cooled gaseous refrigerant 168, refrigeration to the third heat exchanger section 198A being supplied by the first stream of expanded cold refrigerant 166 which is warmed in the cold side of the third heat exchanger section 198A to produce the first stream of warmed gaseous refrigerant 131, as previously described.

The second portion 107 of the second stream of cooled gaseous refrigerant passes through and is cooled in the warm side of the fourth heat exchanger section 196 to produce a second portion the further cooled second stream of cooled gaseous refrigerant 111, which is then combined with the first portion 168 to provide the further cooled second stream of cooled gaseous refrigerant that is then split to provide the third stream of cooled gaseous refrigerant 170 and the fourth stream of cooled gaseous refrigerant 169, as previously described. In a preferred embodiment, the second portion 107 of the second stream of cooled gaseous refrigerant is between about 50 mole % and 95 mole % of the second stream of cooled gaseous refrigerant 160.

As noted above, in the embodiment shown in FIG. 5 a head 118 is used to separate the cold side (shell side) of the warm section 198A from the cold side (shell side) of the middle section 198B of the MCHE 198, so as to prevent refrigerant in the cold sides of the cold and middle sections 198C, 198B from flowing into the cold side of the warm section 198A and thereby allowing the shell side of these sections to have different pressures. However, in an alternative embodiment two separate coil wound heat exchangers units with separate shell casings could be used, with the warm section 198A being enclosed in one shell casing, and with the middle section 198B and cold section 198C being enclosed in another shell casing, thus eliminating the need for the head 118.

In an alternative embodiment, instead of being used to cool a portion 107 of the second stream of cooled gaseous refrigerant the fourth heat exchanger section 196 may instead be used to cool a natural gas stream. For example, natural gas feed stream 104 may be divided into two streams, with a first stream being passed through and cooled in the warm side of the third heat exchanger section 198A as previously described, and with a second stream being passed through and cooled in the warm side of the fourth heat exchanger section 196, the cooled natural gas streams exiting the third and fourth heat exchanger sections being recombined and mixed to form the precooled natural gas stream 105 that is then further cooled and liquefied in the first heat exchanger section 198B as previously described. In yet another variant, the fourth heat exchanger section could have a warm side that defines more than one separate passage through the section, and could be used to cool both a portion 107 of the second stream of cooled gaseous refrigerant and a natural gas stream.

The embodiment shown in FIG. 5 has the benefits of the embodiment shown in FIG. 3, which includes higher process efficiency than the prior art. In addition, since only one stream of refrigerant (the first stream of expanded cold refrigerant 166) passes through the cold side of third heat exchanger section 198A, a coil wound heat exchanger section may be used for this section. However, this arrangement does require the use of an additional piece of equipment in the form of the fourth heat exchanger section 196.

Figure 6:
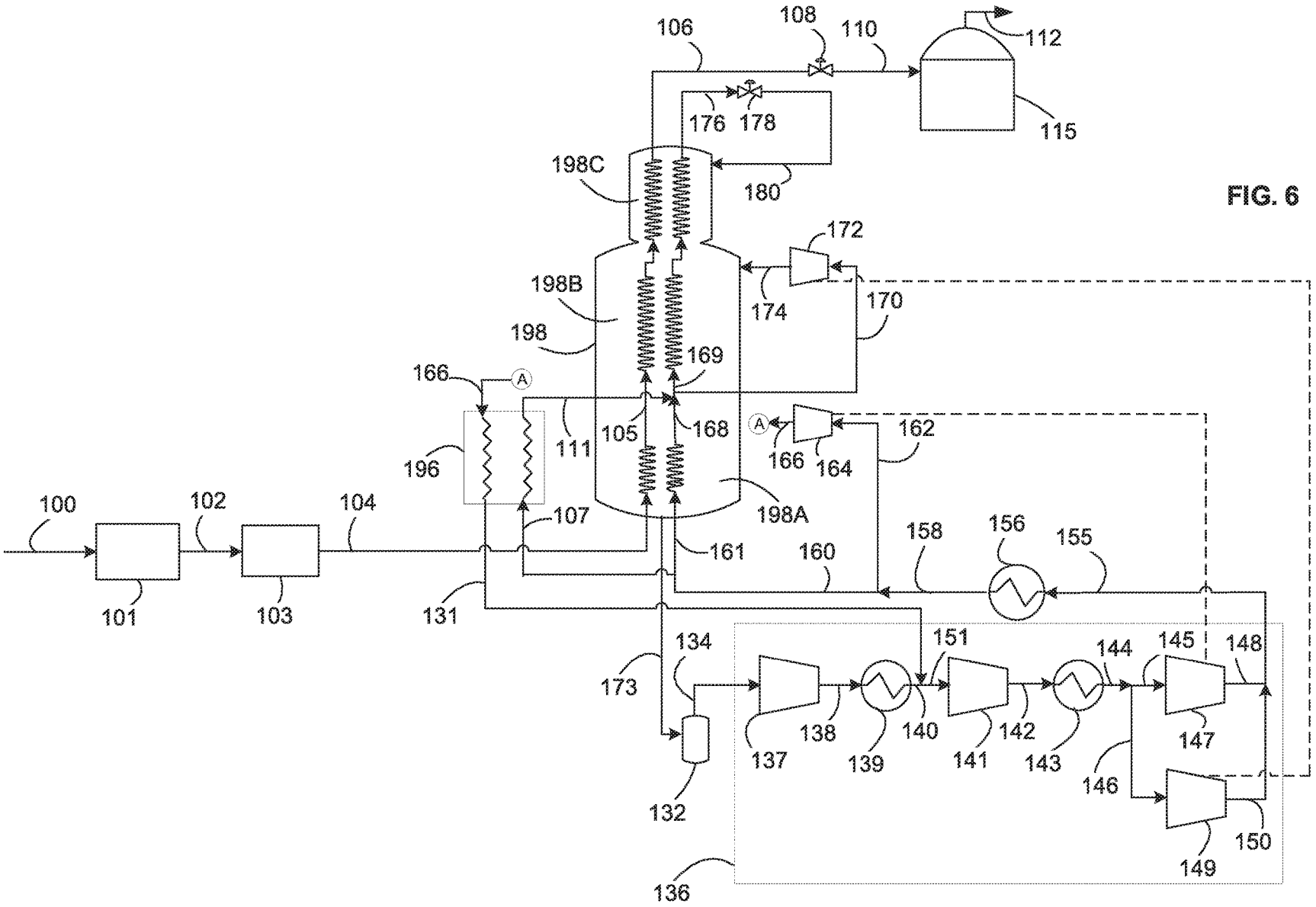
FIG. 6 is a schematic flow diagram depicting a natural gas liquefaction method and system in accordance with a fourth embodiment.

FIG. 6 shows a fourth embodiment and a variation of FIG. 5. In this embodiment the MCHE 198 is again preferably a coil-wound heat exchanger that comprises the third heat exchanger section (the warm section/tube bundle) 198A, first heat exchanger section (the middle section/tube bundle) 198B, and second heat exchanger section (the cold section/tube bundle) 198C. However, the MCHE 198 no longer contains a head 118 that separates the cold side (shell side) of the warm section 198A from the cold side (shell side) of the middle section 198B, and refrigeration for the warm section is 198A is no longer provided by the first stream of expanded cold refrigerant 166. Instead, the mixed stream of the warmed second and third streams of expanded cold refrigerant from the warm end of the cold side (shell side) of the first heat exchanger section (middle section) 198B flows on into, passes through and is further warmed in the cold side (shell side) of the third heat exchanger section 198A to provide cooling duty in the third heat exchanger section 198A, the mixed stream of the second and third streams of expanded cold refrigerant being further warmed in said third heat exchanger section 198A to form the second stream of warmed gaseous refrigerant 173.

Similarly, in the embodiment shown in FIG. 6, refrigeration for the fourth heat exchanger section 196 is no longer provided by a mixed stream of the warmed second and third streams of expanded cold refrigerant. Instead, the first stream of expanded cold refrigerant 166 passes through and is warmed in the cold side of the fourth heat exchanger section 196 to provide cooling duty in the fourth heat exchanger section 196, the first stream of expanded cold refrigerant 166 being warmed in said section to produce the first stream of warmed gaseous refrigerant 131.

As described above in relation to FIG. 5, in the embodiment shown in FIG. 6 a first portion 161 of the second stream of cooled gaseous refrigerant is passed through and cooled in the warm side of the third heat exchanger section 198A to produce a first portion the further cooled second stream of cooled gaseous refrigerant 168, and a second portion of 107 of the second stream of cooled gaseous refrigerant is passed through and cooled in the warm side of the fourth heat exchanger section 196 to produce a to produce a second portion the further cooled second stream of cooled gaseous refrigerant 111, which is then combined with the first portion 168 to provide the further cooled second stream of cooled gaseous refrigerant that is then split to provide the third stream of cooled gaseous refrigerant 170 and the fourth stream of cooled gaseous refrigerant 169. In a preferred embodiment, the second portion 107 of the second stream of cooled gaseous refrigerant is between about 20 mole % and 60 mole % of the second stream of cooled gaseous refrigerant 160.

Alternatively, and as also described above in relation to FIG. 5, in variant of the embodiment shown in FIG. 6 the fourth heat exchanger section 196 may be used to cool a natural gas stream instead of being used to cool a portion 107 of the second stream of cooled gaseous refrigerant. In yet another variant (again as also described above in relation to FIG. 5), the fourth heat exchanger section 196 could have a warm side that defines more than one separate passage through the section, and could be used to cool both a portion 107 of the second stream of cooled gaseous refrigerant and a natural gas stream.

The embodiment shown in FIG. 6 has the benefits of the embodiment shown in FIG. 3, which includes higher process efficiency than the prior art. In addition, since only one stream of refrigerant (the mixed stream of the second and third streams of expanded cold refrigerant) passes through the cold side of third heat exchanger section 198A, a coil wound heat exchanger may be used for this section. However, this arrangement does require the use of an additional piece of equipment in the form of the fourth heat exchanger section 196. As compared to the embodiment shown in FIG. 5, the embodiment of FIG. 6 is a simpler than the embodiment of FIG. 5, since the head 118 is not required and no stream of refrigerant needs to be extracted from the shell side of the MCHE 198 at the warm end of the middle section 198B, resulting in a simpler heat exchanger design.

Figure 7:
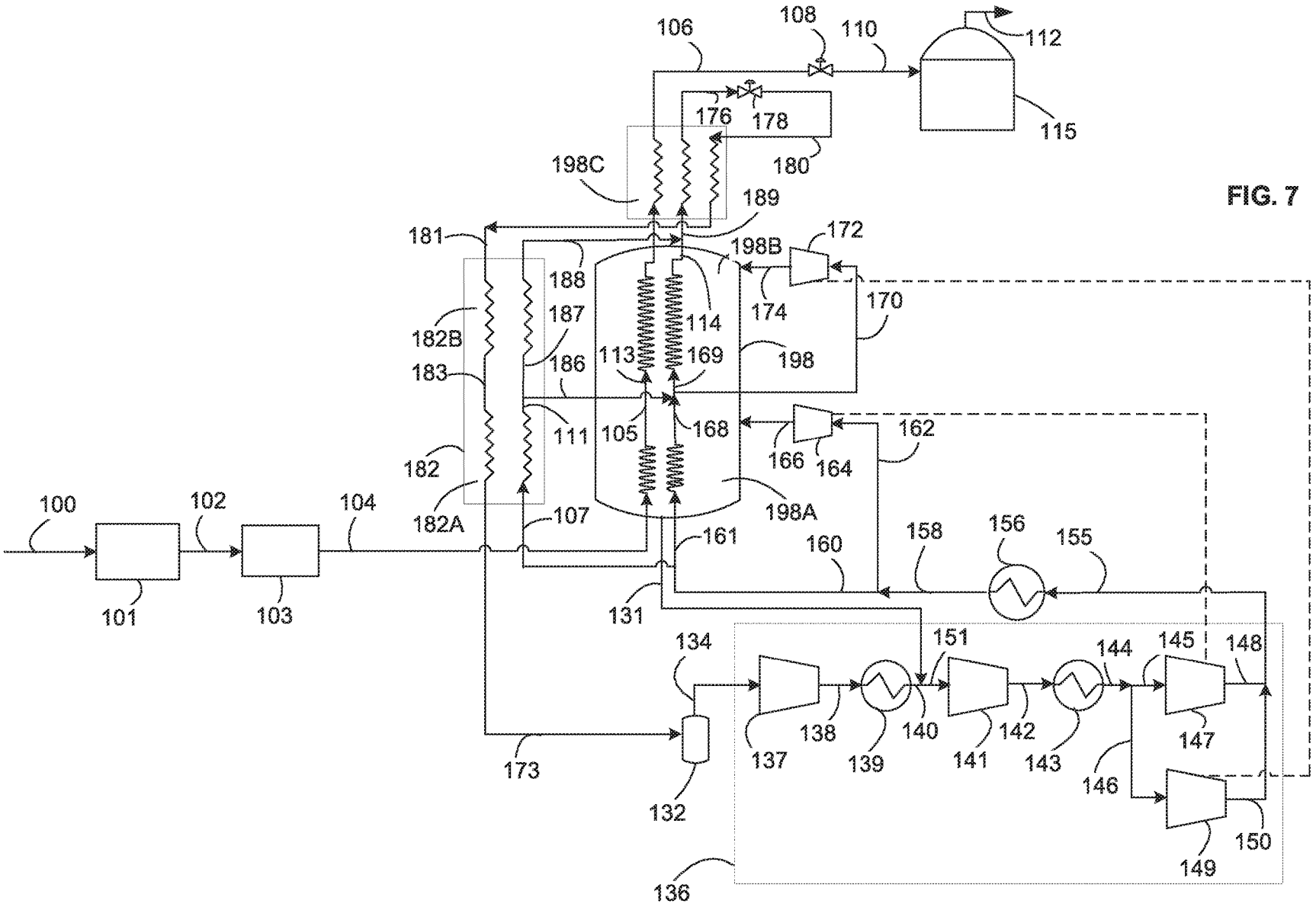
FIG. 7 is a schematic flow diagram depicting a natural gas liquefaction method and system in accordance with a fifth embodiment.

FIG. 7 shows a fifth embodiment and another variation of FIG. 3. The MCHE 198 in this embodiment may be of any type, but again is preferably a coil-wound heat exchanger. In this case it has two heat exchanger sections (i.e. two tube bundles in the case where the MCHE is a coil wound heat exchanger), namely the first heat exchanger section 198B (equivalent to the middle section of the MCHE 198 in FIGS. 1 and 2) in which the precooled natural gas feed stream 105 is liquefied, and the third exchanger section 198A (equivalent to the warm section of the MCHE in FIGS. 1 and 2) in which the natural gas feed stream 104 is precooled to provide the precooled natural gas feed stream 105 that is liquefied in the first heat exchanger section. In lieu of the cold section 198C of the MCHE 198 of FIGS. 1 and 2, in this embodiment the second heat exchanger section 198C (in which the liquefied natural gas feed stream from the first heat exchanger section 198B is subcooled) is located in a separate unit, and is a plate and fin heat exchanger section (as depicted), a shell and tube heat exchanger heat exchanger section, a coil wound heat exchanger section or any other suitable type of heat exchanger section known in the art. Alternatively, the MCHE 198 could be a coil-wound heat exchanger with three heat exchanger sections, with the second heat exchanger section 198C constituting the cold section 198C in the MCHE 198, but with the MCHE 198 containing also a head separating the cold side (shell side) of the first heat exchanger section (middle section) 198B from the cold side (shell side) of the second heat exchanger section (cold section) 198C such that refrigerant cannot flow from the cold side of the second heat exchanger section 198C to the cold sides of the first and third heat exchanger sections 198B, 198A. Although the third and first heat exchanger sections 198A and 198B are depicted as being housed within the same shell casing, in an alternative arrangement each of these sections could be housed in its own shell casing.

In this embodiment the closed-loop refrigeration circuit also further comprises a fourth heat exchanger section 182A and a fifth heat exchanger section 1828, which are depicted in FIG. 7 as warm 182A and cold 1828 sections, respectively, of a plate and fin heat exchanger unit 182. However, in alternative embodiments the fourth and fifth heat exchanger sections 182A and 1828 could be separate units and/or could be heat exchanger sections/units of a different type, such as shell and tube heat exchanger sections, coil wound heat exchanger sections, or any other type of suitable heat exchanger section known in the art. In an alternative embodiment the second heat exchanger section 198C could also be part of the same heat exchanger unit as the fourth and fifth heat exchanger sections 182A and 1828, with the fourth 182A, fifth 1828 and second 198C heat exchanger sections being, respectively, the warm, middle and cold sections of the unit.

As in the embodiment depicted in FIG. 3, the cooled compressed gaseous refrigerant stream 158 is split into two streams, namely a first stream of cooled gaseous refrigerant 162 and a second stream of cooled gaseous refrigerant 160. The first stream of cooled gaseous refrigerant 162 is expanded down to a first pressure in the first turbo-expander 164 (also referred to herein as the warm expander) to produce the first stream of expanded cold refrigerant 166 at a first temperature and said first pressure and that is at least predominantly gaseous having a vapor fraction greater than 0.95 as it exits the first turbo-expander. The first stream of expanded cold refrigerant 166 is passed through the cold side of the third heat exchanger section 198A where it is warmed to provide refrigeration and cooling duty for pre-cooling the natural gas feed stream 104 and cooling a portion 161 of the second stream of cooled gaseous refrigerant 160.

The second stream of cooled gaseous refrigerant 160 is split into two portions, namely a first portion 161 and a second portion 107. The first portion 161 passes through and is cooled in the warm side of the third heat exchanger section 198A, via a separate passage in said warm side to the passage through which the natural gas feed stream 104 is passed, to produce a first portion 168 of the further cooled second stream of cooled gaseous refrigerant. The second portion 107 of the second stream of cooled gaseous refrigerant passes through and is cooled in the warm side of the fourth heat exchanger section 182A to produce a second portion 111 of the further cooled second stream of cooled gaseous refrigerant.

The first portion 168 of the further cooled second stream of cooled gaseous refrigerant is split to form the third stream of cooled gaseous refrigerant 170 and fourth stream of cooled gaseous refrigerant 169.

The fourth stream of cooled gaseous refrigerant 169 passes through and is further cooled and optionally at least partially liquefied in the warm side of the first heat exchanger section 198B, via a separate passage in said warm side to the passage through which the precooled natural gas feed stream 105 is passed, to form a further cooled fourth stream of refrigerant 114.

The third stream of cooled gaseous refrigerant 170 is expanded down to a third pressure in the second turbo-expander 172 (also referred to herein as the cold expander) to produce a third stream of expanded cold refrigerant 174 at a third temperature and said third pressure and that is at least predominantly gaseous having a vapor fraction greater than 0.95 as it exits the second turbo-expander. The third temperature is lower than the first temperature, and the third pressure is substantially the same as the first pressure. The third stream of expanded cold refrigerant 174 passes through the cold side of the first heat exchanger section 198B where it is warmed to provide refrigeration and cooling duty for liquefying the precooled natural gas feed stream 105 and cooling the fourth stream of cooled gaseous refrigerant 169, and then passes through and is further warmed in the cold side of the third heat exchanger section 198A where it mixes with first stream of expanded cold refrigerant 166 and provides additional refrigeration and cooling duty for pre-cooling the natural gas feed stream 104 and cooling the first portion 161 of the second stream of cooled gaseous refrigerant, the first and third streams of expanded cold refrigerant thereby being mixed and warmed to form the first stream of warmed gaseous refrigerant 131 that is then compressed in the compression system 136.

The second portion 111 of the further cooled second stream of cooled gaseous refrigerant forms a fifth stream of cooled gaseous refrigerant 187. Preferably, as shown in FIG. 7, the second portion 111 is split to form the fifth stream of cooled gaseous refrigerant 187 and a balancing stream 186 of cooled gaseous refrigerant.

The balancing stream 186 is mixed with the first portion 168 of the further cooled second stream of cooled gaseous refrigerant, prior to said first portion being is split to form the third and fourth streams of cooled gaseous refrigerant 170, 169, and/or is mixed with the third and/or fourth streams of cooled gaseous refrigerant 170, 169 prior to said streams being, respectively, expanded in the second turbo-expander 172 or further cooled in the first heat exchanger section 198B.

The fifth stream of cooled gaseous refrigerant 187 passes through and is further cooled and optionally at least partially liquefied in the warm side of the fifth heat exchanger section 1828 to produce a further cooled fifth stream of refrigerant 188 that is then mixed with the further cooled fourth stream of refrigerant 114 exiting the cold end of the warm side of the first heat exchanger section 198B to form a mixed stream 189 of the further cooled fourth and fifth streams of refrigerant.

The mixed stream 189 of the further cooled fourth and fifth streams of refrigerant is then passed through and further cooled and at least partially liquefied (if not already fully liquefied) in the warm side of the second heat exchanger section 198C, via a separate passage in said warm side to the passage through which the natural gas feed stream is passed, to produce the liquid or two-phase stream of refrigerant 176 that is withdrawn from the cold end of the warm side of the second heat exchanger section 198C. The liquid or two-phase stream of refrigerant 176 exiting the warm side of the third heat exchanger section 198C is let down in pressure to a second pressure via throttling in the first J-T valve 178 to produce a second stream of expanded cold stream 180 at a second temperature and said second pressure and which is two-phase in nature as it exits the first J-T valve 178. In a preferred embodiment, the second stream of expanded cold refrigerant 180 has a vapor fraction between about 0.02 to about 0.1 as it exits the first J-T valve 178. The second temperature is lower than the third temperature (and thus is lower also than the first temperature), and the second pressure is lower than the third pressure and first pressure.

The second stream of expanded cold refrigerant 180 is passed through the cold side of the second heat exchanger section 198C, where it is warmed (at least partially vaporizing and/or warming the stream) to provide refrigeration and cooling duty for subcooling the liquefied natural gas feed stream and cooling the mixed stream 189 of the further cooled fourth and fifth streams of refrigerant. The resulting warmed second stream of expanded cold refrigerant 181 is then passed through and further warmed in the cold side of the fifth heat exchanger section 1828 to provide refrigeration and cooling duty for cooling the fifth stream of cooled gaseous refrigerant 183, and the resulting further warmed second stream of expanded cold refrigerant 183 is then passed through and further warmed in the cold side of the fourth heat exchanger section 182A to provide refrigeration and cooling duty for cooling the second portion 107 of the second stream of cooled gaseous refrigerant, the second stream of expanded cold refrigerant thereby being warmed to form the second stream of warmed gaseous refrigerant 173 that is then compressed in the compression system 136.

As noted above, the first pressure (pressure of the first stream of expanded cold refrigerant 166 at the exit of the first turbo-expander 164) and the third pressure (pressure of the third stream of expanded cold refrigerant 174 at the exit of the second turbo-expander 172) are substantially the same, and the second pressure (the pressure of the second stream of expanded cold refrigerant 180 at the exit of the J-T valve 178) is lower than the first pressure and the third pressure. Such differences in pressure as exist between the first and third pressures are as a result pressure drop across the first heat exchanger section 198B. For example, as the third stream of expanded cold refrigerant passes through the cold side of the first heat exchanger section it will typically drop in pressure very slightly, typically by less than 1 bar (e.g. by 1-10 psi (0.07-0.7 bar)), and consequently to allow the third and first streams of expanded cold refrigerant to be at the same pressure when they enter the cold side of the third heat exchanger section and are mixed the third pressure may need to be very slightly (typically less than 1 bar) higher than the first pressure. In a preferred embodiment, the pressure ratio of the first pressure to the second pressure is from 1.5:1 to 2.5:1. In a preferred embodiment, the pressure of the first stream of expanded cold refrigerant 166 and the pressure of the third stream of expanded cold refrigerant 174 are between about 10 bara and 35 bara, while the pressure of the second stream of expanded cold refrigerant 180 is between about 4 bara and 20 bara. Correspondingly, the second stream of warmed gaseous refrigerant 173 has a pressure between about 4 bara and 20 bara, while the first stream of warmed gaseous refrigerant 131 has a pressure between about 10 bara and 35 bara.

In a variant of the embodiment depicted in FIG. 7, the system excludes the second turbo-expander 172 and thus uses only the first turbo-expander 164, that provides both precooling and liquefaction duty, and first J-T valve 178 that provides subcooling duty. In such a scenario, heat exchanger section 198B is omitted and heat exchanger section 198A now acts as the first heat exchanger section and provides both precooling and liquefaction duty.

The purpose of balancing stream 186 in FIG. 7 is to adjust the refrigerant to heat load ratio in the heat exchanger unit 182, comprising the fourth and fifth heat exchanger sections, and the MCHE 198 comprising the third and first heat exchanger sections. Based on the flowrate of the refrigerant in the cold side of the fourth and fifth heat exchanger sections, it may be necessary to adjust the flowrate of the stream(s) being cooled in the warm side of the fourth and fifth heat exchanger sections. This can be achieved by removing some flow through the warm side of heat exchanger unit 182 and sending it to the warm side of the MCHE 198. The balance stream 186 allows for tighter cooling curves (temperature versus heat duty curves) in the heat exchanger unit 182 and the MCHE 198.

In an alternative embodiment, the instead of being used to cool a portion 107 of the second stream of cooled gaseous refrigerant, the fourth 182A and fifth 182B heat exchanger sections may instead be used to cool a natural gas stream. For example, natural gas feed stream 104 may be divided into two streams, with a first stream being passed through and precooled in the warm side of the third heat exchanger section 198A and further cooled and liquefied in the warm side of the first heat exchanger section 198B as previously described, and with a second stream being passed through and precooled in the warm side of the fourth heat exchanger section 182A and further cooled and liquefied in the warm side of the fifth heat exchanger section 1828, the liquefied natural gas streams exiting the fifth and first heat exchanger sections being recombined and mixed to form the liquefied natural gas stream that is then subcooled in the second heat exchanger section 198C as previously described. A bypass stream could similarly be employed for transferring some of the precooled natural gas from the precooled natural gas stream exiting the fourth heat exchanger section to the precooled natural gas stream entering the first heat exchanger section. In yet another variant, the fourth and fifth heat exchanger sections could each have a warm side that defines more than one separate passage through the section, and could be used to cool both a portion 107 of the second stream of cooled gaseous refrigerant and a natural gas stream.

All other aspects of the design and operation of the embodiment depicted in FIG. 7, including any preferred aspects of and/or variants thereof, are the same as described above for the embodiment depicted in FIG. 3.

This embodiment shown in FIG. 7 has the benefits of the embodiment in FIG. 3. Additionally, it may result in a smaller MCHE 198 and higher process efficiency.

Figure 8:
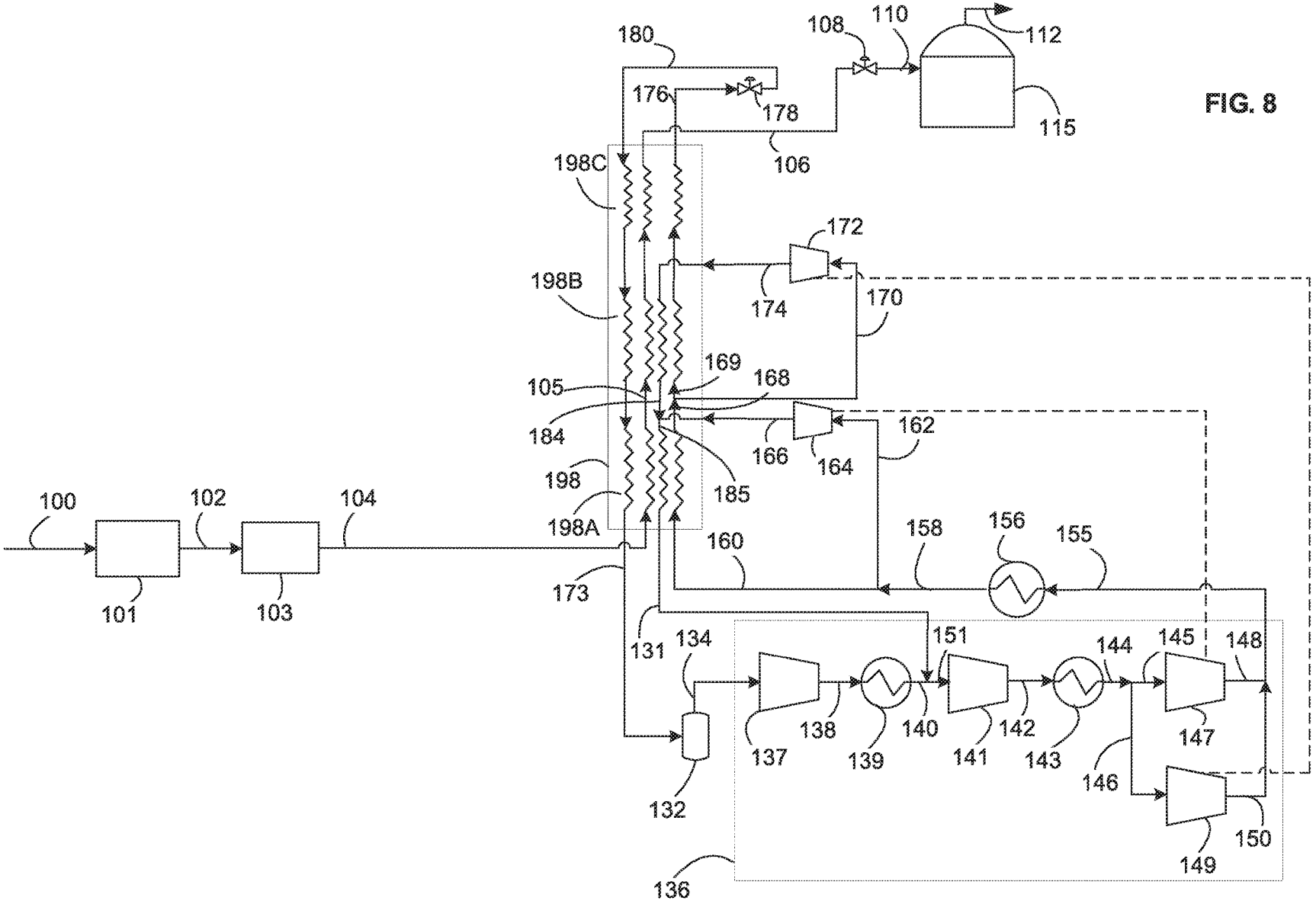
FIG. 8 is a schematic flow diagram depicting a natural gas liquefaction method and system in accordance with a sixth embodiment.

FIG. 8 shows a sixth embodiment and a variation of FIG. 7, in which there is no fourth or fifth heat exchanger sections, and in which the MCHE 198 has three sections, namely the third heat exchanger section (the warm section) 198A, the first heat exchanger section (the middle section) 198B, and the second heat exchanger section (the cold section) 198C, at least the third and first heat exchanger sections being heat exchanger sections of a type that that has a cold side that defines a plurality of separate passages through the heat exchanger section, allowing more than one stream of refrigerant to pass separately through the cold side of said sections without being mixed. As depicted in FIG. 8, the three sections may constitute the warm, middle and cold sections of a single plate and fin heat exchanger unit. Alternatively, however, one or each of the sections may be housed in its own unit, and any suitable type of heat exchanger section known in the art may be used for each section (subject to the requirement that the third and first heat exchanger sections are heat exchanger sections of a type that has a cold side that defines a plurality of separate passages through the section).

In this embodiment the second stream of cooled gaseous refrigerant 160 is not split into first and second portions. Rather, all of the second stream of cooled gaseous refrigerant 160 is passed through and cooled in the warm side of the third heat exchanger section 198A, via a separate passage in said warm side to the passage through which the natural gas feed stream 104 is passed, to produce the further cooled second stream of cooled gaseous refrigerant 168, which is then split to provide the fourth stream of cooled gaseous refrigerant 169 and third stream of cooled gaseous refrigerant 170. The fourth stream of cooled gaseous refrigerant 169 is then passed through and further cooled in the warm side of the first heat exchanger section 198B and warm side of the second heat exchanger section 198C, via separate passages in said warm sides of said first and second heat exchanger sections 198B and 198C to the passages through which the precooled natural gas feed stream 105 is passed, the fourth stream being at least partially liquefied in said first and/or second heat exchanger sections 198B and 198C so as to form the liquid or two-phase stream of refrigerant 176.

The second stream of expanded cold refrigerant 180 passes through and is warmed in, in turn, the cold sides of the second heat exchanger section 198C, first heat exchanger section 198B and third heat exchanger section 198A, thereby providing refrigeration and cooling duty for sub-cooling the liquefied natural gas stream, liquefying the precooled natural gas feed stream 105, cooling the fourth stream of cooled gaseous refrigerant 169, precooling the natural gas stream 104, and cooling the second stream of cooled gaseous refrigerant 160; the second stream of expanded cold refrigerant 180 being thereby warmed and vaporized to form the second stream of warmed gaseous refrigerant 173, that is then compressed in the refrigerant compression system 136. The third stream of expanded cold refrigerant 174 passes through and is warmed in the cold side of the first heat exchanger section 198B, via a separate passage in the cold side of said section to the passage through which the second stream of expanded cold refrigerant is passed, thereby providing further refrigeration and cooling duty for liquefying the precooled natural gas feed stream 105 and cooling the fourth stream of cooled gaseous refrigerant 169. The resulting warmed stream 184 of the third stream of expanded cold refrigerant exiting the warm end of the cold side of the first heat exchanger section 198B is then mixed with the first stream of expanded cold refrigerant 166 to produce a mixed stream of expanded cold refrigerant 185. The mixed stream of expanded cold refrigerant 185 then passes through and is warmed in the cold side of the third heat exchanger section 198A, via a separate passage in the cold side of said section to the passage through which the second stream of expanded cold refrigerant is passed, thereby providing further refrigeration and cooling duty for precooling the natural gas stream 104 and cooling the second stream of cooled gaseous refrigerant 160; the mixed stream of expanded cold refrigerant 185 being thereby warmed to form the first stream of warmed gaseous refrigerant 131, that is then compressed in the refrigerant compression system 136.

In an alternative embodiment and variant of FIG. 8, the third stream of cooled gaseous refrigerant 170 is expanded in the second turbo-expander 172 down to a third pressure that is different from the first pressure and second pressure, the third pressure being lower than the first pressure but higher than the second pressure, and the warmed stream 184 of the third stream of expanded cold refrigerant exiting the warm end of the cold side of the first heat exchanger section 198B is not mixed with the first stream expanded cold refrigerant 166 in the cold side of the third heat exchanger section 198A. In this arrangement the third heat exchanger section 198A has a cold side that defines at least three separate passages through the section, with the second, first and third streams of expanded cold refrigerant being passed separately through the third heat exchanger section 198A so as to form three separate streams of warmed gaseous refrigerant at three separate pressures that are then introduced into refrigerant compression system 136 of the compressor train at three different pressure locations.

This embodiment has the benefits associated with the embodiment of FIG. 7, has a lower heat exchanger count, and is a viable option for peak shaving facilities. However, it looses the benefits of using coil wound heat exchanger sections and, in particular, results in a plant having a larger footprint.

In the above described embodiments presented herein, the need for external refrigerants can be minimised, as all the cooling duty for liquefying and sub-cooling the natural gas is provided by a refrigerant that comprises methane or a mixture of methane and nitrogen. Methane (and typically some nitrogen) will be available on-site from the natural gas feed, while such nitrogen as may be added to the refrigerant to further enhance efficiency may be generated on-site from air.

To further enhance efficiency, the refrigeration cycles described above also employ multiple cold streams of the refrigerant at different pressures, wherein one or more cold gaseous or predominantly gaseous refrigerant streams produced by one or more turbo-expanders, are used to provide the refrigeration for liquefying and, optionally, precooling the natural gas, and wherein a two-phase cold refrigerant stream produced by a J-T valve provides the refrigeration for sub-cooling the natural gas.

In all the embodiments presented herein, inlet and outlet streams from heat exchanger sections may be side-streams withdrawn part-way through the cooling or heating process. For instance, in FIG. 3 mixed stream 171 and/or first stream of expanded cold refrigerant 166 may be side-streams in the third heat exchanger section 197. Further, in all the embodiments presented herein, any number of gas phase expansion stages may be employed.

Any and all components of the liquefaction systems described herein may be manufactured by conventional techniques or via additive manufacturing.

Example 1

In this example, the method of liquefying a natural gas feed stream described and depicted in FIG. 3 was simulated. The results are shown in Table 1 and reference numerals of FIG. 3 are used.

TABLE 1

| Ref. # | Temp, F. | Temp, C. | Pressure, psia | Pressure, bara | Flow, lbmol/hr | Flow, kgmol/hr | Vapor fraction |
|---|---|---|---|---|---|---|---|
| 104 | 108 | 42 | 814 | 56 | 16,000 | 7,257 | 1 |
| 105 | −44 | −42 | 809 | 56 | 16,000 | 7,257 | 1 |
| 106 | −245 | −154 | 709 | 49 | 16,000 | 7,257 | 0 |
| 131 | 96 | 36 | 387 | 27 | 31,372 | 14,230 | 1 |
| 142 | 218 | 103 | 721 | 50 | 92,303 | 41,868 | 1 |
| 155 | 210 | 99 | 1257 | 87 | 92,303 | 41,868 | 1 |
| 158 | 102 | 39 | 1250 | 86 | 92,303 | 41,868 | 1 |
| 160 | 102 | 39 | 1250 | 86 | 60,931 | 27,638 | 1 |
| 166 | −34 | −36 | 394 | 27 | 31,372 | 14,230 | 1 |
| 168 | −44 | −42 | 1245 | 86 | 60,931 | 27,638 | 1 |
| 169 | −44 | −42 | 1245 | 86 | 4,697 | 2,131 | 1 |
| 171 | −65 | −54 | 175 | 12 | 60,931 | 27,638 | 1 |
| 173 | 96 | 36 | 170 | 12 | 60,931 | 27,638 | 1 |
| 174 | −207 | −133 | 182 | 13 | 56,233 | 25,507 | 1 |
| 176 | −245 | −154 | 1145 | 79 | 4,697 | 2,131 | 0 |
| 180 | −248 | −156 | 184 | 13 | 4,697 | 2,131 | 0.05 |

In this example, the circulating refrigerant (as represented by the cooled compressed gaseous refrigerant stream 158) is 54 mole % nitrogen and 46 mole % methane. The ratio of refrigerant that provides evaporative refrigeration is 0.05. The pressure of the first stream of expanded cold refrigerant 166 is higher than that of the third stream of expanded cold refrigerant 174. In comparison, for the prior art arrangement shown in FIG. 2, the first stream of expanded cold refrigerant 166, the third stream of expanded cold refrigerant 174, and the second stream of expanded cold refrigerant 180 are at similar pressure of about 15.5 bara (225.5 psia). This pressure variance in the embodiment of FIG. 3 increases the process efficiency of the embodiment of FIG. 3 by about 5% as compared to the efficiency of FIG. 2 (prior art).

This example is also applicable to the embodiments of FIG. 5 and FIG. 6, resulting in similar benefits as shown in example 1. Referring to the embodiment of FIG. 5, the second portion 107 of the second stream of cooled gaseous refrigerant is about 90% of the second stream of cooled gaseous refrigerant 160. Referring to the embodiment of FIG. 6, the second portion 107 of the second stream of cooled gaseous refrigerant is about 40% of the second stream of cooled gaseous refrigerant 160.

Example 2

In this example, the method of liquefying a natural gas feed stream described and depicted in FIG. 8 was simulated. The results are shown in Table 2 and reference numerals of FIG. 8 are used.

TABLE 2

| Ref. # | Temp, F. | Temp, C. | Pressure, psia | Pressure, bara | Flow, lbmol/hr | Flow, kgmol/hr | Vapor fraction |
|---|---|---|---|---|---|---|---|
| 104 | 108 | 42 | 814 | 56 | 16000 | 7257 | 1 |
| 105 | −59 | −50 | 764 | 53 | 16000 | 7257 | 1 |
| 106 | −245 | −154 | 664 | 46 | 16000 | 7257 | 0 |
| 131 | 96 | 35 | 275 | 19 | 92742 | 42067 | 1 |
| 142 | 248 | 120 | 631 | 44 | 99503 | 45134 | 1 |
| 155 | 231 | 111 | 1257 | 87 | 99503 | 45134 | 1 |
| 158 | 102 | 39 | 1250 | 86 | 99503 | 45134 | 1 |
| 160 | 102 | 39 | 1250 | 86 | 66773 | 30288 | 1 |
| 166 | −63 | −53 | 282 | 19 | 32730 | 14846 | 1 |
| 168 | −59 | −50 | 1200 | 83 | 66773 | 30288 | 1 |
| 169 | −59 | −50 | 1200 | 83 | 6761 | 3067 | 1 |
| 173 | 96 | 35 | 125 | 9 | 6761 | 3067 | 1 |
| 174 | −184 | −120 | 287 | 20 | 60012 | 27221 | 1 |
| 176 | −245 | −154 | 1100 | 76 | 6761 | 3067 | 0 |
| 180 | −248 | −156 | 137 | 9 | 6761 | 3067 | 0.05 |

In this example, the circulating refrigerant (as represented by the cooled compressed gaseous stream 158) is 36 mole % nitrogen and 64 mole % methane. The ratio of refrigerant that provides evaporative refrigeration is 0.07. The pressure of the third stream of expanded cold refrigerant 174 is higher than that of the second stream of expanded cold refrigerant 180. This pressure variance in the embodiment of FIG. 8 increases the process efficiency of the embodiment of FIG. 8 by about 5% as compared to the efficiency of FIG. 2 (prior art).

It will be appreciated that the invention is not restricted to the details described above with reference to the preferred embodiments but that numerous modifications and variations can be made without departing from the spirit or scope of the invention as defined in the following claims.

The invention claimed is:

1. A method for liquefying a natural gas feed stream to produce an LNG product, the method comprising:

passing a natural gas feed stream through and cooling the natural gas feed stream in the warm side of some or all of a plurality of heat exchanger sections so as to liquefy and subcool the natural gas feed stream, the plurality of heat exchanger sections comprising a first heat exchanger section in which a natural gas stream is liquefied, a second heat exchanger section in which the liquefied natural gas stream from the first heat exchanger section is subcooled, and a third heat exchanger section in which a natural gas stream is precooled prior to being liquefied in the first heat exchanger section, the liquefied and subcooled natural gas stream being withdrawn from the second heat exchanger section to provide an LNG product; and circulating a refrigerant, comprising 20-70 mole % nitrogen and 30-80 mole % methane, in a refrigeration circuit comprising the plurality of heat exchanger sections, a compressor train comprising a plurality of compressors and/or compression stages and one or more intercoolers and/or aftercoolers, a first turbo-expander, a second turbo-expander and a first J-T valve, wherein the circulating refrigerant provides refrigeration to each of the plurality of heat exchanger sections and thus cooling duty for liquefying and subcooling the natural gas feed stream, and wherein circulating the refrigerant in the refrigerant circuit comprises the steps of:

(i) splitting a compressed and cooled gaseous stream of the refrigerant to form a first stream of cooled gaseous refrigerant and a second stream of cooled gaseous refrigerant;

(ii) expanding the first stream of cooled gaseous refrigerant down to a first pressure in the first turbo-expander to form a first stream of expanded cold refrigerant at a first temperature and said first pressure, the first stream of expanded cold refrigerant being a gaseous or predominantly gaseous stream containing no or substantially no liquid as it exits the first turbo-expander;

(iii) passing the second stream of cooled gaseous refrigerant through and cooling the second stream of cooled gaseous refrigerant in the warm side of at least one of the plurality of heat exchanger sections, splitting the resulting further cooled second stream of cooled gaseous refrigerant to form a third stream of cooled gaseous refrigerant and fourth stream of cooled gaseous refrigerant, and passing the fourth stream of cooled gaseous refrigerant through and further cooling and at least partially liquefying the fourth stream of cooled gaseous refrigerant in the warm side of at least another one of the plurality of heat exchanger sections comprising at least the second heat exchanger section to form a liquid or two-phase stream of refrigerant;

(iv) expanding the liquid or two-phase stream of refrigerant down to a second pressure by throttling said stream through the first J-T valve to form a second stream of expanded cold refrigerant at a second temperature and said second pressure, the second stream of expanded cold refrigerant being a two-phase stream as it exits the J-T valve, the second pressure being lower than the first pressure and the second temperature being lower than the first temperature;

(v) expanding the third stream of cooled gaseous refrigerant down to a third pressure in the second turbo-expander to form a third stream of expanded cold refrigerant at a third temperature and said third pressure, the third stream of expanded cold refrigerant being a gaseous or predominantly gaseous stream containing no or substantially no liquid as it exits the second turbo-expander, the third temperature being lower than the first temperature but higher than the second temperature;

(vi) passing the first stream of expanded cold refrigerant through and warming the first stream of expanded cold refrigerant in the cold side of at least one of the plurality of heat exchanger sections, comprising at least the third heat exchanger section and/or a heat exchanger section in which all or part of the second stream of cooled gaseous refrigerant is cooled, passing the third stream of expanded cold refrigerant through and warming the third stream of expanded cold refrigerant in the cold side of at least one of the plurality of heat exchanger sections, comprising at least the first heat exchanger section and/or a heat exchanger section in which all or a part of the fourth stream of cooled gaseous refrigerant is further cooled, and passing the second stream of expanded cold refrigerant through and warming the second stream of expanded cold refrigerant in the cold side at least one of the plurality of heat exchanger sections, comprising at least the second heat exchanger section, wherein the first and second streams of expanded cold refrigerant are kept separate and not mixed in the cold sides of any of the plurality of heat exchanger sections, the first stream of expanded cold refrigerant being warmed to form all or part of a first stream of warmed gaseous refrigerant and the second stream of expanded cold refrigerant being warmed and vaporized to form all or part of a second stream of warmed gaseous refrigerant; and (vii) introducing the first stream of warmed gaseous refrigerant and the second stream of warmed gaseous refrigerant into the compressor train, whereby the second stream of warmed gaseous refrigerant is introduced into compressor train at a different, lower pressure location of the compressor train than the first stream of warmed gaseous refrigerant, and compressing, cooling and combining the first stream of warmed gaseous refrigerant and second stream of warmed gaseous refrigerant to form the compressed and cooled gaseous stream of the refrigerant that is then split in step (i);

and wherein either:

(a) the third pressure is the substantially the same as the second pressure, the third stream of expanded cold refrigerant passing through and being warmed in the cold side of at least the first heat exchanger section and the second stream of expanded cold refrigerant passing through and being warmed in the cold side of at least the second heat exchanger section and then passing through and being further warmed in the cold side of at least the first heat exchanger section where it mixes with the third stream of expanded cold refrigerant; the third heat exchanger section is a coil wound heat exchanger section comprising a tube bundle having tube-side and a shell side; and the plurality of heat exchanger sections further comprise a fourth heat exchanger section in which a natural gas stream is precooled and/or in which all or a part of the second stream of cooled gaseous refrigerant is cooled, the first stream of expanded cold refrigerant passing through and being warmed in the cold side of one of the third and fourth heat exchanger sections to form the first stream of warmed gaseous refrigerant, and a mixed stream of the second and third streams of expanded cold refrigerant from the first heat exchanger section passing through and being further warmed in the cold side of the other of the third and fourth heat exchanger sections to form the second stream of warmed gaseous refrigerant; or (b) the third pressure is the substantially the same as the first pressure, the third stream of expanded cold refrigerant and first stream of expanded cold refrigerant being mixed and warmed in the cold side of at least one of the plurality of heat exchanger sections, the third and first streams of expanded cold refrigerant being mixed and warmed to form the first stream of warmed gaseous refrigerant; the plurality of heat exchanger sections further comprise a fourth heat exchanger section in which a natural gas stream is precooled and/or in which all or a part of the second stream of cooled gaseous refrigerant is cooled, and a fifth heat exchanger section in which a natural gas stream is liquefied and/or in which all or a part of the fourth stream or a fifth stream of cooled gaseous refrigerant is further cooled, wherein said fifth stream of cooled gaseous refrigerant, where present, is formed from another portion of the further cooled second stream of cooled gaseous refrigerant; and the second stream of expanded cold refrigerant, after passing through and being warmed in the cold side of the second heat exchanger section, is passed through and is further warmed in the cold side of at least the fifth heat exchanger section and then the fourth heat exchanger section.

2. The method of claim 1, wherein the refrigerant comprises 25-65 mole % nitrogen and 30-80 mole % methane.

3. The method of claim 1, wherein the first stream of expanded cold refrigerant has a vapor fraction of greater than 0.95 as it exits the first turbo-expander, and the second stream of expanded cold refrigerant has a vapor fraction of 0.02 to 0.1 as it exits the J-T valve.

4. The method of claim 1, wherein the ratio of refrigerant that provides evaporative refrigeration is from 0.02 to 0.2, the ratio of refrigerant that provides evaporative refrigeration being defined as the total molar flow rate of all liquid or two-phase streams of refrigerant in the refrigeration circuit that are expanded through J-T valves to form streams of expanded cold two-phase refrigerant that are warmed and vaporized in one or more of the plurality of heat exchanger sections, divided by the total molar flow rate of all of the refrigerant circulating in the refrigeration circuit.

5. The method of claim 1, wherein the pressure ratio of the first pressure to the second pressure is from 1.5:1 to 2.5:1.

6. The method of claim 1, wherein the liquefied and subcooled natural gas stream is withdrawn from the second heat exchanger section at a temperature of −130 to −155° C.

7. The method of claim 1, wherein the refrigeration circuit is a closed-loop refrigeration circuit.

8. The method of claim 1, wherein the first heat exchanger section is a coil wound heat exchanger section comprising a tube bundle having tube-side and a shell side.

9. The method of claim 1, wherein second heat exchanger section is a coil wound heat exchanger section comprising a tube bundle having tube-side and a shell side.

10. The method of claim 1, wherein: the third pressure is the substantially the same as the second pressure, the third stream of expanded cold refrigerant passing through and being warmed in the cold side of at least the first heat exchanger section and the second stream of expanded cold refrigerant passing through and being warmed in the cold side of at least the second heat exchanger section and then passing through and being is further warmed in the cold side of at least the first heat exchanger section where it mixes with the third stream of expanded cold refrigerant; the third heat exchanger section is a coil wound heat exchanger section comprising a tube bundle having tube-side and a shell side; and the plurality of heat exchanger sections further comprise a fourth heat exchanger section in which a natural gas stream is precooled and/or in which all or a part of the second stream of cooled gaseous refrigerant is cooled, the first stream of expanded cold refrigerant passing through and being warmed in the cold side of one of the third and fourth heat exchanger sections to form the first stream of warmed gaseous refrigerant, and a mixed stream of the second and third streams of expanded cold refrigerant from the first heat exchanger section passing through and being further warmed in the cold side of the other of the third and fourth heat exchanger sections to form the second stream of warmed gaseous refrigerant.

11. The method of claim 10, wherein the first heat exchanger section is a coil wound heat exchanger section comprising a tube bundle having tube-side and a shell side, and the second heat exchanger section is a coil wound heat exchanger section comprising a tube bundle having tube-side and a shell side.

12. The method of claim 11, wherein said tube bundles of the first and second heat exchanger sections are contained within the same shell casing.

13. The method of claim 1, wherein: the third pressure is the substantially the same as the first pressure, the third stream of expanded cold refrigerant and first stream of expanded cold refrigerant being mixed and warmed in the cold side of at least one of the plurality of heat exchanger sections, the third and first streams of expanded cold refrigerant being mixed and warmed to form the first stream of warmed gaseous refrigerant; the plurality of heat exchanger sections further comprise a fourth heat exchanger section in which a natural gas stream is precooled and/or in which all or a part of the second stream of cooled gaseous refrigerant is cooled, and a fifth heat exchanger section in which a natural gas stream is liquefied and/or in which all or a part of the fourth stream or a fifth stream of cooled gaseous refrigerant is further cooled, wherein said fifth stream of cooled gaseous refrigerant, where present, is formed from another portion of the further cooled second stream of cooled gaseous refrigerant; and the second stream of expanded cold refrigerant, after passing through and being warmed in the cold side of the second heat exchanger section, is passed through and is further warmed in the cold side of at least the fifth heat exchanger section and then the fourth heat exchanger section.

14. The method of claim 13, wherein the first stream of expanded cold refrigerant passes through and is warmed in the cold side of at least the third heat exchanger section, and wherein the third stream of expanded cold refrigerant passes through and is warmed in the cold side of at least the first heat exchanger section and then passes through and is further warmed in the cold side of at least the third heat exchanger section where it mixes with the first stream of expanded cold refrigerant.

15. The method of claim 14, wherein the first heat exchanger section is a coil wound heat exchanger section comprising a tube bundle having tube-side and a shell side, and the third heat exchanger section is a coil wound heat exchanger section comprising a tube bundle having tube-side and a shell side.

16. The method of claim 15, wherein said tube bundles of the first and third heat exchanger sections are contained within the same shell casing.

17. The method of claim 1, wherein the third stream of expanded cold refrigerant has a vapor fraction of greater than 0.95 as it exits the second turbo-expander.

18. A system for liquefying a natural gas feed stream to produce an LNG product, the system comprising a refrigeration circuit for circulating a refrigerant, the refrigerant circuit comprising:

a plurality of heat exchanger sections, each of the heat exchanger sections having a warm side and a cold side, the plurality of heat exchanger sections comprising a first heat exchanger section, a second heat exchanger section and a third heat exchanger section, wherein the warm side of the first heat exchanger section defines at least one passage therethrough for receiving, cooling and liquefying a natural gas stream, wherein the warm side of the second heat exchanger section defines at least one passage therethrough for receiving and sub-cooling a liquefied natural gas stream from the from the first heat exchanger section to as to provide an LNG product, wherein the warm side of the third heat exchanger section defines at least one passage therethrough for receiving and precooling a natural gas stream prior to said stream being received and further cooled and liquefied in the first heat exchanger section, and wherein the cold side of each of the plurality of heat exchanger sections defines at least one passage therethrough for receiving and warming an expanded stream of the circulating refrigerant that provides refrigeration to the heat exchanger section;

a compressor train, comprising a plurality of compressors and/or compression stages and one or more intercoolers and/or aftercoolers, for compressing and cooling the circulating refrigerant, wherein the refrigeration circuit is configured such that the compressor train receives a first stream of warmed gaseous refrigerant and a second stream of warmed gaseous refrigerant from the plurality of heat exchanger sections, the second stream of warmed gaseous refrigerant being received at and introduced into a different, lower pressure location of the compressor train than the first stream of warmed gaseous refrigerant, the compressor train being configured to compress, cool and combine the first stream of warmed gaseous refrigerant and second stream of warmed gaseous refrigerant to form a compressed and cooled gaseous stream of the refrigerant;

a first turbo-expander configured to receive and expand a first stream of cooled gaseous refrigerant down to a first pressure to form a first stream of expanded cold refrigerant at a first temperature and said first pressure; and a first J-T valve configured to receive and expand a liquid or two-phase stream of refrigerant down to a second pressure by throttling said stream to form a second stream of expanded cold refrigerant at a second temperature and said second pressure, the second pressure being lower than the first pressure and the second temperature being lower than the first temperature;

a second turbo-expander configured to receive and expand a third stream of cooled gaseous refrigerant down to a third pressure to form a third stream of expanded cold refrigerant at a third temperature and said third pressure, the third temperature being lower than the first temperature but higher than the second temperature;

wherein the refrigerant circuit is further configured so as to:

split the compressed and cooled gaseous stream of the refrigerant from the compressor train to form the first stream of cooled gaseous refrigerant and a second stream of cooled gaseous refrigerant;

pass the second stream of cooled gaseous refrigerant through and cool the second stream of cooled gaseous refrigerant in the warm side of at least one of the plurality of heat exchanger sections, split the resulting further cooled second stream of cooled gaseous refrigerant to form the third stream of cooled gaseous refrigerant and a fourth stream of cooled gaseous refrigerant, and pass the fourth stream of cooled gaseous refrigerant through and further cool and at least partially liquefy the fourth stream of cooled gaseous refrigerant in the warm side of at least another one of the plurality of heat exchanger sections comprising at least the second heat exchanger section to form the liquid or two-phase stream of refrigerant; and pass the first stream of expanded cold refrigerant through and warm the first stream of expanded cold refrigerant in the cold side of at least one of the plurality of heat exchanger sections, comprising at least the third heat exchanger section and/or a heat exchanger section in which all or part of the second stream of cooled gaseous refrigerant is cooled, pass the third stream of expanded cold refrigerant through and warm the third stream of expanded cold refrigerant in the cold side of at least one of the plurality of heat exchanger sections, comprising at least the first heat exchanger section and/or a heat exchanger section in which all or a part of the fourth stream of cooled gaseous refrigerant is further cooled, and pass the second stream of expanded cold refrigerant through and warm the second stream of expanded cold refrigerant in the cold side at least one of the plurality of heat exchanger sections, comprising at least the second heat exchanger section, wherein the first and second streams of expanded cold refrigerant are kept separate and not mixed in the cold sides of any of the plurality of heat exchanger sections, the first stream of expanded cold refrigerant being warmed to form all or part of the first stream of warmed gaseous refrigerant and the second stream of cold refrigerant being warmed and vaporized to form all or part of the second stream of warmed gaseous refrigerant;

and wherein either:

(a) the third pressure is the substantially the same as the second pressure, the third stream of expanded cold refrigerant passing through and being warmed in the cold side of at least the first heat exchanger section and the second stream of expanded cold refrigerant passing through and being warmed in the cold side of at least the second heat exchanger section and then passing through and being further warmed in the cold side of at least the first heat exchanger section where it mixes with the third stream of expanded cold refrigerant; the third heat exchanger section is a coil wound heat exchanger section comprising a tube bundle having tube-side and a shell side; and the plurality of heat exchanger sections further comprise a fourth heat exchanger section in which a natural gas stream is precooled and/or in which all or a part of the second stream of cooled gaseous refrigerant is cooled, the first stream of expanded cold refrigerant passing through and being warmed in the cold side of one of the third and fourth heat exchanger sections to form the first stream of warmed gaseous refrigerant, and a mixed stream of the second and third streams of expanded cold refrigerant from the first heat exchanger section passing through and being further warmed in the cold side of the other of the third and fourth heat exchanger sections to form the second stream of warmed gaseous refrigerant; or (b) the third pressure is the substantially the same as the first pressure, the third stream of expanded cold refrigerant and first stream of expanded cold refrigerant being mixed and warmed in the cold side of at least one of the plurality of heat exchanger sections, the third and first streams of expanded cold refrigerant being mixed and warmed to form the first stream of warmed gaseous refrigerant; the plurality of heat exchanger sections further comprise a fourth heat exchanger section in which a natural gas stream is precooled and/or in which all or a part of the second stream of cooled gaseous refrigerant is cooled, and a fifth heat exchanger section in which a natural gas stream is liquefied and/or in which all or a part of the fourth stream or a fifth stream of cooled gaseous refrigerant is further cooled, wherein said fifth stream of cooled gaseous refrigerant, where present, is formed from another portion of the further cooled second stream of cooled gaseous refrigerant; and the second stream of expanded cold refrigerant, after passing through and being warmed in the cold side of the second heat exchanger section, is passed through and is further warmed in the cold side of at least the fifth heat exchanger section and then the fourth heat exchanger section.

* * * * *